US008007879B2

(12) United States Patent
Nakano

(10) Patent No.: US 8,007,879 B2
(45) Date of Patent: Aug. 30, 2011

(54) RECORDING MEDIUM AND PRODUCING METHOD THEREOF, AND INKJET RECORDING METHOD

(75) Inventor: Ryoichi Nakano, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 417 days.

(21) Appl. No.: 12/272,509

(22) Filed: Nov. 17, 2008

(65) Prior Publication Data

US 2009/0130347 A1 May 21, 2009

(30) Foreign Application Priority Data

Nov. 19, 2007 (JP) ..... 2007-299933

(51) Int. Cl.
*B41M 5/00* (2006.01)

(52) U.S. Cl. ..... 428/32.21; 428/32.24; 428/32.25; 428/32.31; 428/32.34; 428/32.38; 427/243; 427/245; 347/101; 347/102; 347/105

(58) Field of Classification Search ..... 428/32.21, 428/32.24, 32.25, 32.31, 32.34, 32.38; 427/243, 427/245; 347/101, 102, 105
See application file for complete search history.

(56) References Cited

U.S. PATENT DOCUMENTS

| | | | | |
|---|---|---|---|---|
| 2001/0009712 | A1* | 7/2001 | Totani et al. | 428/195 |
| 2004/0090513 | A1* | 5/2004 | Ohya et al. | 347/105 |
| 2005/0069655 | A1 | 3/2005 | Yamamoto et al. | |

FOREIGN PATENT DOCUMENTS

| | | | |
|---|---|---|---|
| JP | 3-234698 | A | 10/1991 |
| JP | 10-168791 | A | 6/1998 |
| JP | 11-78224 | A | 3/1999 |
| JP | 2002-69890 | A | 3/2002 |
| JP | 2004-291520 | A | 10/2004 |
| JP | 2007-245617 | A | 9/2007 |
| WO | 2006/037085 | A2 | 4/2006 |

OTHER PUBLICATIONS

EP Communication, dated Feb. 5, 2009, issued in corresponding EP Application No. 08020086.8, 5 pages.

* cited by examiner

*Primary Examiner* — Betelhem Shewareged
(74) *Attorney, Agent, or Firm* — Sughrue Mion, PLLC

(57) ABSTRACT

The invention provides a recording medium excellent in the water resistance and image fixability and a producing method thereof and an inkjet recording method using the recording medium, comprising: sequentially laminated, a base paper; a first layer containing a binder; and a second layer containing a white pigment and at least one selected from the group consisting of a urethane resin and an acrylic resin, each having a glass transition temperature of 50° C. or less, wherein a Cobb water absorption degree during a contact time of 120 sec in a water absorption test in accordance with JIS P8140 on a surface of the first layer disposed on the base paper is 2.0 g/m$^2$ or less and an amount of water absorption during a contact time of 0.5 sec in the Bristow method on a surface of the second layer is 2 to 8 mL/m$^2$.

12 Claims, 3 Drawing Sheets

RECORDING MEDIUM AND PRODUCING METHOD THEREOF, AND INKJET RECORDING METHOD

CROSS-REFERENCE TO RELATED APPLICATION

This application claims priority under 35 USC 119 from Japanese Patent Application No. 2007-299933, the disclosure of which is incorporated by reference herein.

BACKGROUND OF THE INVENTION

1. Field of the Invention

The present invention relates to a recording medium, a producing method thereof and an inkjet recording method that uses the same.

2. Description of the Related Art

An inkjet recording unit has a simple configuration and high quality image recording may be realized through inkjet recording using the inkjet recording unit. Ink used in inkjet recording is controlled such that a viscosity thereof is substantially from several mPa·s to 30 mPa·s such that it may be discharged from an inkjet head, and configured such that the surface tension may be substantially from 20 to 40 mN/m.

In order to control the viscosity of the ink to within this range, an ink solvent is usually contained in the ink at an amount of from 50% to 90% by mass. Examples of ink solvents include water, organic solvents, oils and photopolymerizing monomers. From the viewpoint of the environmental aptitude in particular, water is frequently used. Furthermore, in order to inhibit clogging due to drying of the ink solvent at a discharge nozzle of an inkjet head, a high boiling point solvent such as glycerin is generally used as an ink solvent.

However, when an ink solvent is present in a large amount in a ink drawn recording medium, image blurring and color mixing between colors are likely to be caused due to the abundancy of the ink solvent. Accordingly, inkjet-only paper 200 (see FIG. 5) having a solvent absorption layer (ink-receiving layer) that absorbs the ink solvent and has a thickness of substantially 20 to 30 μm is used as a recording medium, thereby inhibiting image blurring and color mixing.

Furthermore, in the case of aqueous ink where water is used as an ink solvent, water permeates into the base paper at the time of recording to cause paper deformation such as curling. However, as shown in FIG. 5, when a recording medium has a solvent absorbing layer 22 on a base paper 21, water is inhibited from permeating into the base paper; accordingly, the paper may be inhibited from deforming.

In this case in particular, when a graphical image having a high image density or having a high image area ratio is to be formed, an ink amount on a unit area on the recording medium increases, making it difficult for a solvent absorption layer to inhibit the ink solvent from permeating into the base paper. Accordingly, a water resistant paper covered with a resin layer that uses polyolefin (such as laminated paper) is generally used.

Inkjet technology has been applied recently not only in the fields of office printers and home printers but also in commercial printing. In the field of the commercial printing, rather than paper that has a photograph-like surface that completely shuts out the ink solvent from permeating into a base paper, paper having printing texture similar to general printing paper is demanded. However, when a solvent absorbing layer that forms part of a recording medium becomes as thick as 20 to 30 μm, the surface glossiness, texture and hardness of the recording medium are limited; accordingly, inkjet technology in the commercial printing field is applied only to posters and ledger sheets printing in which the surface glossiness, texture and hardness of a recording medium may be limited.

Furthermore, owing to the adoption of the solvent absorbing layer and water resistant layer, the recording medium becomes expensive, and this is also a limiting factor.

As a technology related to the above, in order to improve color development characteristics and to inhibit bleeding and ink strike-through from occurring, a recording sheet formed by disposing an ink-retaining layer made of at least a filler, a water-soluble polymer and an aqueous emulsion resin on an anti-ink permeation layer containing an aqueous emulsion resin has been disclosed (see, for example, Japanese Patent Application Laid-Open (JP-A) No. 3-234698). In order to improve the wet tensile strength, and a dissociation property and an ink setting property upon recycling, a coated paper obtained by sequentially disposing a water resistant layer including an SBR resin having a predetermined glass transition temperature, and a printing layer including a filler-coated layer has been disclosed (see, for example, Japanese Patent Application Laid-Open (JP-A) No. 2002-69890). Further, a printing coated paper in which, in order to improve blister resistance and glossiness, two or more coated layers are disposed on a surface, and an undercoat layer adjacent to the uppermost layer includes a predetermined thermoplastic adhesive, has been disclosed (see, for example, Japanese Patent Application Laid-Open (JP-A) No. 10-168791). An image receiving paper provided with a paper support having thereon a water-repelling layer containing a binder and a filler, and an ink receiving layer in order to improve the water resistance has been disclosed (see, for example, Japanese Patent Application Laid-Open (JP-A) No. 11-78224).

SUMMARY OF THE INVENTION

However, even when inventions disclosed in the patent literatures are applied, in some cases, sufficient water resistance is not necessarily obtained. Furthermore, there are cases where the fixing force of an image formed on a surface of a recording medium is weak for an image to be peeled off a surface of a recording medium due to scrubbing.

The present invention has been made in view of the above circumstances and provides a recording medium excellent in the water resistance and image fixability and a producing method thereof and an inkjet recording method therewith. A first aspect of the present invention provides a recording medium, comprising: sequentially laminated, a base paper; a first layer containing a binder; and a second layer containing a white pigment and at least one selected from the group consisting of a urethane resin and an acrylic resin, which each have a glass transition temperature of 50° C. or less, wherein a Cobb water absorption degree during a contact time of 120 sec in a water absorption test in accordance with JIS P8140 on a surface of the first layer disposed on the base paper is 2.0 $g/m^2$ or less and an amount of water absorption during a contact time of 0.5 sec in the Bristow method on a surface of the second layer is 2 $mL/m^2$ or more and 8 $mL/m^2$ or less.

A second aspect of the present invention provides a method of producing a recording medium according to the first aspect, comprising: forming, on a base paper, a film-forming solution containing thermoplastic resin particles, followed by heating in a temperature region equal to or more than the minimum film-forming temperature of the thermoplastic resin particles to form a first layer; and forming, on the first layer, a film-forming solution containing a white pigment and at least one selected from the group consisting of a urethane resin and an acrylic resin, which each have a glass transition temperature of 50° C. or less, to form a second layer.

A third aspect of the present invention provides an inkjet recording method, comprising: applying a treatment solution containing an acidic substance to the recording medium according to the first aspect of the invention; applying an ink to the recording medium to which the treatment solution is fed to perform ink drawing in accordance with predetermined image data; and drying and removing an ink solvent in the ink drawn recording medium.

BRIEF DESCRIPTION OF THE DRAWINGS

Exemplary aspects of the invention will be described in detail based on the following figures, wherein.

DETAILED DESCRIPTION

Figure 1:
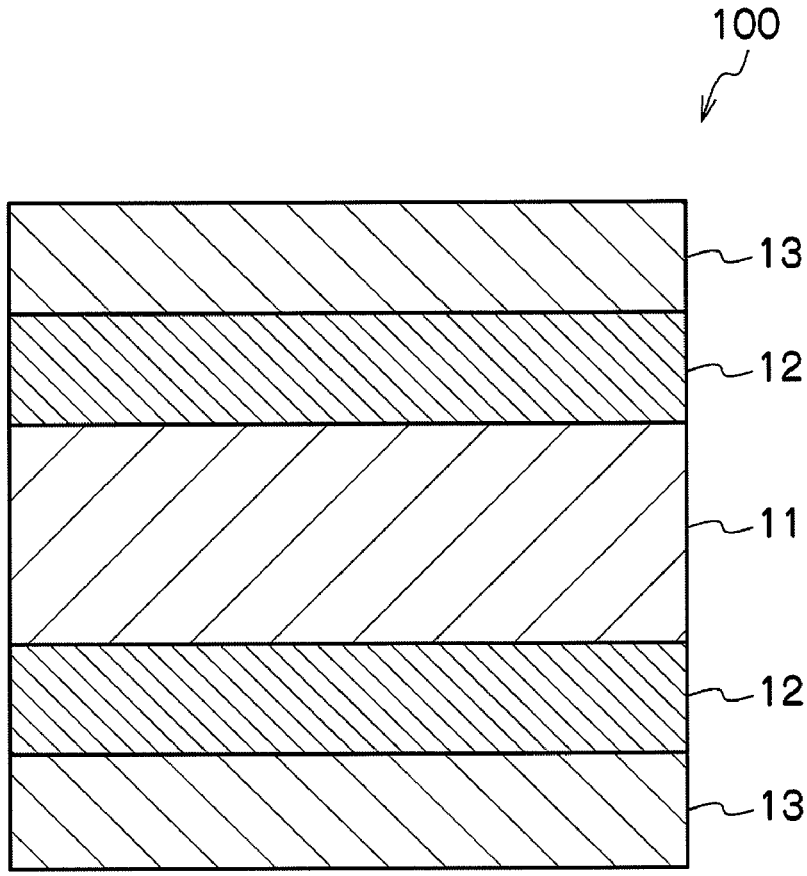
FIG. 1 is a schematic constitutional diagram showing a configuration example of a recording medium of the invention.

Exemplary embodiments of the invention are described in detail hereinafter.

The above-described problems are solved by the invention as described below.

The invention in accordance with a first aspect of the invention is a recording medium, comprising: sequentially laminated, a base paper; a first layer containing a binder; and a second layer containing a white pigment and at least one selected from the group consisting of a urethane resin and an acrylic resin, which each have a glass transition temperature of 50° C. or less, wherein a Cobb water absorption degree during a contact time of 120 sec in a water absorption test in accordance with JIS P8140 on a surface of the first layer disposed on the base paper is 2.0 g/m$^2$ or less and an amount of water absorption during a contact time of 0.5 sec in the Bristow method on a surface of the second layer is 2 mL/m$^2$ or more and 8 mL/m$^2$ or less.

The invention in accordance with a second aspect of the invention is the recording medium according to the first aspect, wherein a content of the white pigment in the second layer is from 70% to 96% by mass with respect to a total solid content of the second layer.

The invention in accordance with a third aspect of the invention is the recording medium according to the first or the second aspect, wherein the binder in the first layer contains a thermoplastic resin.

The invention in accordance with a fourth aspect of the invention is the recording medium according to the third aspect, wherein the thermoplastic resin is at least one selected from the group consisting of a urethane resin and an acrylic resin.

The invention in accordance with a fifth aspect of the invention is the recording medium according to the third or fourth aspect, wherein the glass transition temperature of the thermoplastic resin is 30° C. or more.

The invention in accordance with a sixth aspect of the invention is the recording medium according to any one of the first to fifth aspects, wherein the acrylic resin is an acryl silicone resin.

The invention in accordance with a seventh aspect of the invention is the recording medium according to any one of the first to sixth aspects, wherein the first layer further contains a white pigment.

The invention in accordance with an eighth aspect of the invention is the recording medium according to any one of the first to seventh aspects, wherein the white pigment is kaolin.

The invention in accordance with a ninth aspect of the invention is a method of producing the recording medium according to any one of the third to eighth aspects, comprising: forming, on a base paper, a film-forming solution containing thermoplastic resin particles, followed by heating in a temperature region equal to or more than the minimum film-forming temperature of the thermoplastic resin particles to form a first layer; and forming, on the first layer, a film-forming solution containing a white pigment and at least one selected from the group consisting of a urethane resin and an acrylic resin, which each have a glass transition temperature of 50° C. or less, to form a second layer.

The invention in accordance with a tenth aspect of the invention is the method of producing a recording medium according to ninth aspect, wherein the thermoplastic resin particles comprise at least one selected from the group consisting of a urethane resin latex and an acrylic resin latex.

The invention in accordance with a eleventh aspect of the invention is an inkjet recording method, comprising: applying an ink to the recording medium according to any one of first to eighth aspects to perform ink drawing in accordance with predetermined image data; and drying and removing an ink solvent in the ink drawn recording medium.

The invention in accordance with a twelfth aspect of the invention is an inkjet recording method, comprising: applying a treatment solution containing an acidic substance to the recording medium according to any one of first to eighth aspects; applying an ink to the recording medium to which the treatment solution is fed to perform ink drawing in accordance with predetermined image data; and drying and removing an ink solvent in the ink drawn recording medium.

In what follows, a recording medium of the invention and a producing method thereof and an inkjet recording method that uses the recording medium will be described in detail.

<Recording Medium>

A recording medium of the invention is formed by including a base paper, a first layer and a second layer sequentially disposed in this order from the base paper side, and, as needs arise, appropriately selected other layer. A recording medium of the invention, like, for instance, a recording medium 100 shown in FIG. 1, is constituted by disposing a high-quality paper 11 as a base paper, a solvent-blocking layer 12 as a first layer formed on the high-quality paper 11 and a coated layer 13 as a second layer formed on the solvent-blocking layer 12. Furthermore, the recording medium may be either a sheet paper or a roll paper.

(Base Paper)

The base paper is not particularly restricted and may be appropriately selected from known ones depending on the object.

As pulp that is used as a raw material of a base paper, from the viewpoints of simultaneously improving the surface smoothness, stiffness and dimensional stability (curling property) of the base paper with balance to a high level, leaf bleached kraft pulp (LBKP) is desirable. Furthermore, needle bleached kraft pulp (NBKP) and leaf bleached sulfite pulp (LBSP) may be used as well.

When the pulp is digested, a beater or a refiner may be used. In a pulp slurry (hereinafter, in some cases, referred to as "pulp paper stock") obtained after the pulp is digested, as needs arise, various kinds of additives such as a filler, a dry paper strengthening agent, a sizing agent, a wet paper strengthening agent, a fixing agent, a pH regulating agent and other chemicals are added.

Examples of fillers include calcium carbonate, clay, kaolin, white earth, talc, titanium oxide, diatom earth, barium sulfate, aluminum hydroxide and magnesium hydroxide.

Examples of the dry paper strengthening agents include cationized starch, cationized polyacrylamide, anionized polyacrylamide, amphoteric polyacrylamide and carboxy-modified polyvinyl alcohol.

Examples of the sizing agents include fatty acid salt, rosin, rosin-derivatives such as maleinized rosin, paraffin wax, alkyl ketene dimer, alkenyl succinate anhydride (ASA) and epoxidized fatty acid amide.

Examples of the wet paper strengthening agents include polyaminepolyamide epichlorohydrine, a melamine resin, a urea resin and an epoxidized polyamide resin.

Examples of the fixing agents include multi-valent metal salts such as aluminum sulfate or aluminum chloride and cationized polymers such as cationized starch.

Examples of the pH regulating agents include sodium hydroxide and sodium carbonate.

Examples of the other chemicals include a defoaming agent, a dye, a slime control agent and a fluorescent brightener.

Furthermore, to the pulp paper stock, as needs arise, a softener may be added as well. The softener is described in, for instance, "Sin Kamikakou Binran (New Paper Processing Handbook)" (edited by Siyaku Times Co.), 554 to 555 (1980).

In a treatment solution used in surface sizing, for instance, an aqueous polymer, a sizing agent, a water resistant material, a pigment, a pH adjusting agent, a dye and a fluorescent brightener may be contained.

Examples of the aqueous polymers include cationized starch, polyvinyl alcohol, carboxy-modulated polyvinyl alcohol, carboxymethylcellulose, hydroxyethylcellulose, cellulose sulfate, gelatin, casein, sodium polyacrylate, sodium salt of styrene-maleic anhydride copolymer and sodium polystyrene sulfonate.

Examples of the sizing agents include petroleum resin emulsion, ammonium salt of styrene-maleic anhydride copolymer alkyl ester, rosin, higher fatty acid salt, alkyl ketene dimer (AKD) and epoxidized fatty acid amide.

Examples of the water resistant materials include latex emulsions of styrene-butadiene copolymer, ethylene-vinyl acetate copolymer, polyethylene or vinylidene chloride copolymer and polyamidepolyamine epichlorhydrine.

Examples of the pigments include calcium carbonate, clay, kaolin, talc, barium sulfate and titanium oxide.

Examples of the pH adjusting agents include hydrochloric acid, sodium hydroxide and sodium carbonate.

Examples of materials of base papers may include, other than the above-mentioned natural pulps, synthetic pulp paper, mixed paper of natural pulp and synthetic pulp and various kinds of combination papers.

A thickness of the base paper is preferably from 30 to 500 μm, more preferably from 50 to 300 μm and still more preferably from 70 to 200 μm.

(First Layer)

On the base paper of a recording medium of the invention, a first layer is disposed. After the first layer has been disposed, an ink solvent is suppressed from permeating into the base paper. For instance, as a paper provided with a solvent-blocking layer, one where a coating layer mainly made of a polyethylene resin is disposed on a surface of the base paper is known. However, the paper where the solvent-blocking layer is disposed to impart the water resistance is, although substantially complete in the water-blocking effect, not necessarily satisfying in the texture as the paper.

The first layer includes at least a binder and a Cobb water absorption degree of a surface of the first layer of the base paper provided with the first layer is set at 2.0 g/m$^2$ or less during a contact time of 120 sec according to the water absorption test in accordance with JIS P8140. As far as the Cobb water absorption degree is within the range, without particular restriction, the first layer, depending on the object, may be appropriately selected from known ones.

Furthermore, the first layer may be constituted, as needs arise, by use of, other than the binder, other components such as a crosslinking agent and a white pigment.

As the first layer of the present invention, from the viewpoint of suppressing penetration of an ink solvent and obtaining favorable surface properties, a preferable layer is, for example, a layer which contains, as a binder, a thermoplastic resin and contains Kaolin as a white pigment and in which a mass ratio x/y of the mass (solid content) x of thermoplastic resin and the mass y of kaolin is adjusted to from 1 to 30 or a layer containing, in addition to the above-mentioned components, a cross linking agent selected from epoxy compounds, compounds containing an active methylene group, cyanuric chloride, formaldehyde, and carbodiimide.

—Binder—

The first layer includes at least one kind of binders. The binder is used not only to disperse but also to improve the strength of a coated film.

Examples of the binders include a urethane resin, an acrylic resin, polyvinyl alcohol (including modified polyvinyl alcohols such as carboxy-modified, itaconic-modified, maleic-modified, silica-modified or amino group-modified one), methylcellulose, carboxy methylcellulose, starches (including modified starches), gelatin, rubber Arabic, casein, a styrene-maleic anhydride copolymer hydrolysate, polyacrylamide and saponified vinyl acetate-acrylic acid copolymer. Furthermore, latex type thermoplastic resins of synthetic polymers such as styrene-butadiene copolymer, vinyl acetate copolymer, acrylonitrile-butadiene copolymer, methyl acrylate-butadiene copolymer or polyvinylidene chloride.

Examples of the polyvinyl alcohols include polyvinyl alcohols obtained by saponifying a lower alcohol solution of polyvinyl acetate and derivatives thereof and ones obtained by saponifying a copolymer between a monomer copolymerizing with vinyl acetate and vinyl acetate. Herein, examples of the monomers capable of copolymerizing with vinyl acetate include unsaturated carboxylic acid such as (anhydrous) maleic acid, fumaric acid, crotonic acid, itaconic acid, (meth)acrylic acid or an esters thereof; α-olefin such as ethylene or propylene; olefin sulfonic acid such as (meth)allyl sulfonic acid, ethylene sulfonic acid or sulfonic acid alkyl maleate; an alkali salt of olefin sulfonic acid such as sodium (meth)allylsulfonate, sodium ethylene sulfonate, sodium sulfonate alkyl(meth)acrylate, sodium sulfonate (monoalkyl malate) or sodium disulfonate alkyl malate; an amide group-containing monomer such as N-methylolacrylamide or an alkali salt of acrylamide alkylsulfonate; and a N-vinyl pyrolidone derivative.

Examples of the binders further include, in addition to general-purpose thermoplastic polymers such as polyolefins such as homopolymers of α-olefin such as polyethylene, polypropylene or polyvinyl chloride or mixtures thereof; polyamides and polyimides; and polyesters such as polyethylene terephthalate, known thermoplastic resins and latexes thereof such as homopolymers made of α-methylene fatty acid monocarboxylic acid esters such as methyl(meth)acrylate, ethyl(meth)acrylate, butyl(meth)acrylate, dodecyl (meth)acrylate, octyl(meth)acrylate or phenyl(meth)acrylate; styrenes such as styrene, chlorostyrene or vinyl styrene; vinyl esters such as vinyl acetate, vinyl propionate, vinyl succinate or vinyl butyrate; vinyl ethers such as vinyl methyl ether, vinyl ethyl ether or vinyl butyl ether; or vinyl ketones such as vinyl methyl ketone, vinyl hexyl ketone or vinyl isopropyl ketone, or as arbitrary copolymers containing the constitutional units.

Among above-illustrated examples, homopolymers of α-methylene fatty acid monocarboxylic acid esters such as methyl(meth)acrylate, ethyl(meth)acrylate, butyl(meth)acrylate, dodecyl(meth)acrylate, octyl(meth)acrylate or phenyl (meth)acrylate or copolymers containing these constituent units are cited as acrylic resins.

A urethane resin is obtained by heating, for instance, a mixture of polyol and isocyanate to cure. Examples of the polyols include monomers of bifunctional and/or trifunctional polyol or mixtures of two or more kinds thereof and prepolymers containing a hydroxyl group (OH) at a terminal. For instance, polyether polyol, polyester polyol, polycarbonate polyol or polybutadiene polyol may be used.

Examples of latex include latex of thermoplastic resin, such as acrylic latex, acrylic silicone latex, acrylic epoxy latex, acrylic styrene latex, acrylic urethane latex, styrene-butadiene latex, acrylonitrile-butadiene latex, polyester urethane latex, and vinyl acetate latex.

Among these, from the viewpoint of the water-blocking property, a thermoplastic resin is preferred. From the viewpoint of further water-blocking property, at least one kind selected from a group of a urethane resin and acrylic resin is more preferred.

The glass transition temperature (Tg) of the thermoplastic resin contained in the first layer is preferably 30° C. or more, more preferably 30° C. or more and 70° C. or less and particularly preferably 35° C. or more and 60° C. or less. When the Tg is in the range in particular, a film-forming solution (such as coating solution) for forming a first layer is inhibited from causing a problem such as skinning to be easy to handle in production. Furthermore, without causing problems such that the Tg is too high to be able to obtain desired glossiness unless a calender temperature is set rather high and adhesion to a surface of a metal roll tends to occur to adversely affect on a surface state, high glossiness and high planarity are readily obtained.

A molecular weight of the latex, by number average molecular weight, is preferably from 3,000 to 1,000,000 and particularly preferably substantially from 5,000 to 100,000. The molecular weight, when it is 3,000 or more, allows securing the mechanical strength of the first layer and, when it is 1,000,000 or less, is advantageous from the production aptitudes such as dispersion stability and viscosity.

Specifically, as the acrylic latex, commercially available products such as water dispersive latexes described below are used. That is, preferable examples of the acrylic resins include "CEBIAN A4635, 46583 and 4601" (trade name, manufactured by Daicel Chemical Industries, Ltd.) and "NIPOL Lx811, 814, 820, 821 and 857" (trade name, manufactured by ZEON CORPORATION). In particular, acryl emulsions of acryl silicone latexes described in JP-A Nos. 10-264511, 2000-43409, 2000-343811 and 2002-120452 (commercially available products include AQUABRID-series UM7760, UM7761 and UM4901, AQUABRID 903, AQUABRID ASi-86, AQUABRID ASi-89, AQUABRID ASi-91, AQUABRID ASi-753, AQUABRID ASi-4635, AQUABRID ASi-4901, AQUABRID MSi-04S, AQUABRID AU-124, AQUABRID AU-131, AQUABRID AEA-61, AQUABRID AEC-69 and AQUABRID AEC-162) are preferably used.

Examples of the urethane latexes include, as commercially available products, HYDRAN-series (such as HYDRAN AP-20, HYDRAN AP-30, HYDRAN AP-30F, HYDRAN AP-40 (F), HYDRAN AP-50LM, HYDRAN APX-101H, HYDRAN APX-110 or HYDRAN APX-501) (trade name, manufactured by DIC Corporation), VONDIC-series (such as VONDIC1040NS, VONDIC1050B-NS, VONDIC1230NS or VONDIC1850NS) (trade name, manufactured by DIC Corporation), SPENSOL-series (such as SPENSOLL512, SPENSOLL52 or SPENSOLL55) (trade name, manufactured by DIC Corporation) and DICFOAM-series (such as DICFOAM F505EL or DICFOAM F-520) (trade name, manufactured by DIC Corporation). Furthermore, examples include ELASTRON-series (such as ELASTRON E-37, ELASTRON C-9 or ELASTRON S-24) (trade name, manufactured by Daiichi Kogyo Seiyaku Co., Ltd.) and SUPERFLEX-series (such as SUPERFLEX 90, SUPERFLEX 300, SUPERFLEX E-2000, SUPERFLEX R-5000 or SUPERFLEX 600) (trade name, manufactured by Daiichi Kogyo Seiyaku Co., Ltd.).

Among the thermoplastic resins, at least one kind is preferably selected and used. These may be used singularly or in a combination of two or more kinds thereof.

Furthermore, the minimum film-forming temperature of the thermoplastic resin (preferably latex resin fine particles) is preferably from 20 to 60° C. and more preferably from 25 to 50° C. When the minimum film-forming temperature region capable of forming a film when a film is formed is within the range, the film-forming solution for forming the first layer (such as coating solution) is inhibited from a problem such as the skinning to be easy to handle in the production, and, when the second layer is formed, the permeation is suppressed to be excellent in a state of the coated surface of the formed second layer; accordingly, a layer having the microporosity sufficient for speedily transmitting an ink solvent is formed. Only by coating the solution (such as coating solution), excellent glossiness is not necessarily provided. However, when soft calender treatment is applied thereafter, a highly glossy layer having the microporosity is obtained.

A content of the binder (preferably thermoplastic resin) in the first layer is, relative to a total solid content of the first layer, preferably from 15 to 95% by mass and more preferably from 30 to 90% by mass. In the case where the content is within the range in particular, when the calender process is applied, the glossiness and planarity are excellent, the permeability of the ink solvent is obtained and the blurring with time is more effectively inhibited from occurring.

Furthermore, in the first layer, as needs arise, depending on the kind of the binder, an appropriate crosslinking agent of the binder may be added.

—Cobb Water Absorption Degree—

In the invention, the Cobb water absorption degree measured according to the water absorption test based on JIS P8140 from a first layer side of a base paper on which the first layer is disposed for 120 sec is set at 2.0 g/m$^2$ or less. When the Cobb water absorption degree is 2.0 g/m$^2$ or less, the base paper provided with the first layer has mild permeability to be able to delay absorption when a liquid such as ink is provided and reduce the degree of occurrence of curling.

Furthermore, the Cobb water absorption degree is preferred to be 1.0 g/m$^2$ or less. Still furthermore, the minimum value of the Cobb water absorption degree is desirably 0.2 g/m$^2$.

The Cobb water absorption degree is measured according to a water absorption test based on JIS P8140 and an amount of absorbed water measured when water is brought into contact for a definite time from one surface of the base paper, specifically, a surface of the first layer of the base paper on which the first layer is disposed. In the invention, a contact time is set at 120 sec.

In the first layer, other than the components, other components such as a white pigment, a film hardening agent and a layered inorganic compound may be used.

—White Pigment—

Examples of the white pigments include titanium oxide, barium sulfate, barium carbonate, calcium carbonate, lithopone, alumina white, zinc oxide, silica antimony trioxide, titanium phosphate, aluminum hydroxide, kaolin, clay, talc, magnesium oxide and magnesium hydroxide.

Among the above-cited ones, from the viewpoints of the whiteness degree, dispersibility and stability, titanium oxide is particularly preferred. Furthermore, from the viewpoint of the water-blocking property, kaolin is particularly preferred. Examples of kaolin include KAOBRIGHT 90, KAOGLOSS and KAOWHITE (trade name, manufactured by SHIRAISHI CALCIUM KAISHA, LTD.).

In the case where the white pigment is contained in the first layer, when a calender process is applied after the first layer is formed, the first layer is inhibited from sticking to the calender.

As the particle size of the white pigment, particles of 2.0 μm or less are preferably contained 75% or more by volume base. When the particle size is in the range, the whiteness and glossiness become excellent.

Furthermore, the specific surface area of the white pigment due to the BET method is preferred to be less than 100 m$^2$/g. When the white pigment having the specific surface area in the range is contained, when the second layer is coated and formed, the coating solution is inhibited from permeating; accordingly, the ink absorptivity of the second layer is heightened.

The BET method is one of surface area measurement methods of powder due to a gas phase adsorption method and a method where, from an adsorption isotherm, a total surface area that 1 g of sample has, that is, specific surface area is obtained. Usually, a method where, as an adsorption gas, nitrogen gas is used and an absorption amount is measured from a variation of pressure or volume of a gas to be adsorbed is general. As well-known one that expresses an isotherm of multimolecular adsorption, there is an equation of Brunauer, Emmett and Teller (BET equation). Based on the equation, an adsorption amount is obtained, followed by multiplying an area that one absorption molecule occupies on a surface to obtain a surface area.

The white pigments may be used singularly or in a combination of two or more kinds thereof.

A content of the white pigment in the first layer is, though different dependent on the kind of the white pigment, the kind of the thermoplastic resin and the layer thickness, relative to a mass (solid content) of the binder, usually desirably substantially in the range of 5 to 200% by mass.

—Hardener—

The first layer of the invention may include a hardener to harden the binder. Examples of the hardeners include aldehyde compounds, 2,3-dihydroxy-1,4-dioxane and derivatives thereof and compounds that have two or more of vinyl groups adjacent to a substitution group of which Hammett's substituent constant $\sigma_p$ is positive in a single molecule.

When the first layer contains the hardener, without thickening the film-forming solution of the first layer, the water resistance of the recording medium may be improved. Thereby, the coating stability of the film-forming solution of the first layer is improved and thereby the water resistance of the resulting recording medium as well is improved.

Examples of substitutional groups of which Hammett's substituent constant $\sigma_p$ is positive include a $CF_3$ group ($\sigma_p$ value: 0.54), a CN group ($\sigma_p$ value: 0.66), a $COCH_3$ group ($\sigma_p$ value: 0.50), a COOH group ($\sigma_p$ value: 0.45), a COOR (R expresses an alkyl group) group ($\sigma_p$ value: 0.45), a $NO_2$ group ($\sigma_p$ value: 0.78), a $OCOCH_3$ group ($\sigma_p$ value: 0.31), a SH group ($\sigma_p$ value: 0.15), a $SOCH_3$ group ($\sigma_p$ value: 0.49), a $SO_2CH_3$ group ($\sigma_p$ value: 0.72), a $SO_2NH_2$ group ($\sigma_p$ value: 0.57), a $SCOCH_3$ ($\sigma_p$ value: 0.44), a F group ($\sigma_p$ value: 0.06), a Cl group ($\sigma_p$ value: 0.23), a Br group ($\sigma_p$ value: 0.23), a I group ($\sigma_p$ value: 0.18), a $IO_2$ group ($\sigma_p$ value: 0.76), a $N^+(CH_3)_2$ group ($\sigma_p$ value: 0.82), and a $S^+(CH_3)_2$ group ($\sigma_p$ value: 0.90).

Examples of the compounds that have two or more of vinyl groups adjacent to a substitution group of which Hammett's substituent constant $\sigma_p$ is positive in a single molecule include, in addition to 2-ethylenesulfonyl-N-[2-(2-ethylenesulfonyl-acetylamino)-ethyl]acetamide, bis-2-vinylsulfonyl-ethyl ether, bisacryloylimide, N—N'-diacryloyl urea, 1,1-bis-vinylsulfone ethane and ethylene-bis-acrylamide, diacrylate and dimethacrylate compound expressed by formulae below, among these 2-ethylenesulfonyl-N-[2-(2-ethylenesulfonyl-acetylamino)-ethyl]acetamide being particularly preferred.

Structure

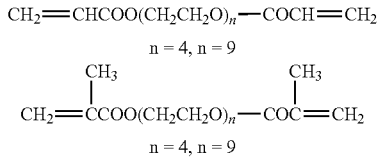

A content of the hardener in the first layer is, relative to a solid content of the binder, preferably 0.1% by mass or more and 30% by mass or less and more preferably 0.5% by mass or more and 10% by mass or less. When the content of the hardener is within the range, the film-forming solution for the first layer is not thickened and the water resistance of the recording medium may be improved.

—Layered Inorganic Compound—

The first layer may further contain a layered inorganic compound. The layered inorganic compound is preferred to be a swelling inorganic layered compound and examples thereof include swelling clayey ores such as bentonite, hectorite, saponite, biederite, nontronite, stevensite, beidelite or montmorillonite, swelling synthetic mica and swelling synthetic smectite. The swelling inorganic layered compound has a stacked structure made of unit crystal lattice layers having a thickness from 1 to 1.5 μm and is very large in the metallic atom substitution within a lattice than other clayey ores; accordingly, a lattice layer causes positive charge deficiency and, in order to compensate the deficiency, positive ions such as $Na^+$, $Ca^{2+}$ or $Mg^{2+}$ are adsorbed between layers. The positive ion interposing between the layers is called an exchangeable positive ion and is exchanged by various positive ions. In particular when the interlayer positive ion is $Li^+$ or $Na^+$, owing to small ionic radius, bonding between layered crystal lattices is weak to be largely swollen by water. When shearing force is applied in this state, the layered inorganic compound is readily cleaved to form stable sol in water. Bentonite and water swellable synthetic mica are preferred because this tendency is strong. The water swellable synthetic mica is particularly preferred.

Examples of the water swellable synthetic micas include sodium tetrasilicic mica $NaMg_{2.5}(Si_4O_{10})F_2Na$, lithium teniolite $(NaLi)Mg_2(Si_4O_{10})F_2Na$ or lithium hectolite $(NaLi)/3Mg_2/3Li_{1/3}SiO_4O_{10})F_2$.

As to the size of the water swellable mica, it is preferable that a thickness is from 1 to 50 nm and a face size is from 1 to 20 μm. In order to control the diffusion, the thinner the thickness is, the better, and a plain size is better larger within a range that does not deteriorate the smoothness and transparency of a coated surface. Accordingly, the aspect ratio is preferably 100 or more, more preferably 200 or more and particularly preferably 500 or more.

When the water swellable synthetic mica is used, a mass ratio x/y of a mass (solid content) x of a binder in the first layer to a mass y of water swellable synthetic mica is preferably in the range of 1 or more and 30 or less and more preferably in the range of 5 or more and 15 or less. When the mass ratio is within the range, oxygen permeation and blister generation are effectively suppressed.

In the first layer, a known additive such as an anti-oxidant as well may be added.

A thickness of the first layer is preferably in the range of 1 to 30 μm and more preferably in the range of 5 to 20 μm. When the thickness of the first layer is within the range, the surface glossiness when the calender treatment is applied later is improved, the whiteness is obtained with a slight amount of the white pigment and the handling property such as folding aptitude is made same as that of a coat paper or an art paper.

(Second Layer)

A recording medium of the invention further has a second layer on the first layer on the base paper.

The second layer includes a white pigment and at least one kind selected from a group made of a urethane resin and acrylic resin, which have the glass transition temperature of 50° C. or less, and an amount of water absorption in a surface of the second layer measured during a contact time of 0.5 sec according to the Bristow method is 2 $mL/m^2$ or more and 8 $mL/m^2$ or less. When the amount of water absorption is within the range, without particular restriction, the second layer, depending on the object, may be appropriately selected from known materials.

Furthermore, the second layer, as needs arise, may be constituted with other components.

The second layer in the invention is preferred to be, for instance, a layer that further includes a thermoplastic resin, a layer that further contains a thermoplastic resin of 10 to 60 parts by solid mass to 100 parts by solid mass of the white pigment or a layer where the pH of a layer surface is 4 or less.

—White Pigment—

The second layer includes at least one kind of the white pigments. When the white pigment is contained, ink (pigment in ink in particular) may be kept in the second layer and the background whiteness as well may be heightened.

The white pigments may be selected, without particular restriction, from ones that are used generally as the white pigment for printing coat papers such as calcium carbonate, kaolin, titanium dioxide, aluminum trihydroxide, zinc oxide, barium sulfate, satin white or talc.

Among these, from the viewpoint of the glossiness, kaolin is particularly preferred. Examples of kaolin include KAOBRIGHT 90, KAOGLOSS and KAOWHITE (trade name, manufactured by SHIRAISHI CALCIUM KAISHA, LTD.).

When the recording medium of the invention is applied to an inkjet recording method involving first or second aspects of the invention described below, that is, when the pH of a layer surface of the second layer is controlled to an acidic side (preferably 4 or less) or a treatment solution containing an acidic substance described below is used to perform ink drawing, from the viewpoints of avoiding the blurring or color mixing of an image when ink drawing is applied, a content of calcium carbonate is, to a total pigment in the second layer, preferably 5% by mass or less, more preferably 1% by mass or less and still more preferably calcium carbonate is not contained.

A content of the white pigment in the second layer is, to a total solid content of the second layer, preferably from 70 to 96% by mass and more preferably from 80 to 94% by mass.

Furthermore, a ratio of the white pigment and resin component (based on mass) in the second layer is preferably from 2:1 to 30:1, more preferably from 3:1 to 25:1 and particularly preferably from 5:1 to 20:1. When the ratio of the white pigment and resin component is in the range of 2:1 to 30:1, a state of the coated surface is excellent and the image blurring and color mixing between colors are more effectively inhibited from occurring.

A preferable particle size of the white pigment contained in the second layer is same as the case of the first layer.

—Resin Component—

In the second layer, at least one kind selected from a group made of a urethane resin and acrylic resin, which have the glass transition temperature of 50° C. or less, is contained. The urethane resin and acrylic resin contained in the second layer, as far as they have the glass transition temperature of 50° C. or less, are not particularly restricted. The glass transition temperature thereof is more preferably −20° C. or more and 50° C. or less and particularly preferably −15° C. or more and 50° C. or less. When the Tg is 50° C. or less, the tape peelability is preferable.

In the second layer, as the resin component, the urethane resins may be contained singularly or in a combination of two or more kinds thereof. Furthermore, the acrylic resins may be used singularly or in a combination of two or more kinds thereof. Still furthermore, one kind or two or more kinds of the urethane resins and one kind or two or more kinds of the acrylic resins may be used together.

The molecular weight of the urethane resin and acrylic resin contained in the second layer is, by number average molecular weight, preferably from 3,000 to 1,000,000 and particularly preferably substantially from 5,000 to 100,000. When the molecular weight is 3,000 or more, the mechanical strength is obtained and, when it is 1,000,000 or less, production aptitude such as the dispersion stability and viscosity is advantageous.

The urethane resin and acrylic resin contained in the second layer are used by appropriately selecting materials satisfying the conditions of the glass transition temperature from commercially available products illustrated in the description of the first layer.

—Glass Transition Temperature—

In the invention, the glass transition temperature means a value measured according to a method shown below.

In an environment where the humidity is controlled to 50% at 23° C., a test piece of a resin formed in film is heated at a rate of 2° C./min from room temperature to measure the dynamic viscoelasticity and loss tangent of the test piece with a viscoelastometer, and, from a peak temperature of the loss tangent, the glass transition temperature is obtained.

—Amount of Water Absorption According to Bristow Method—

In the invention, an amount of water absorption during a contact time of 0.5 sec in a surface of the second layer due to the Bristow method is set at 2 mL/m$^2$ or more and 8 mL/m$^2$ or less. When the amount of water absorption is 2 to 8 mL/m$^2$, the second layer is mildly permeative to be able to retard liquid absorption at a surface where a liquid such as ink is imparted to suppress the degree of curling and to inhibit the color mixing between colors from occurring. In order to inhibit the blurring or color mixing between colors from occurring, as will be described below, it is particularly effective that the pH of a layer surface of the second layer is controlled acidic (in particular, 4 or less in the pH) or a treatment solution containing an acidic substance described below is used together with ink.

The amount of water absorption in the second layer is more preferable, from the reason same as that mentioned above, to be 2 mL/m$^2$ or more and 4 mL/m$^2$ or less.

The Bristow method is a method used as a method of measuring an amount of liquid absorption during a short time and is adopted also in Japan Technical Association of the Pulp and Paper Industry (J'TAPPI). The detail of the test method will be referenced to J. TAPPI PAPER, Pulp Test Method No. 51 to 87 "Liquid Absorption Test Method of Paper and Paperboard" (Bristow Method) and TAPPI JOURNAL 41(8), 57 to 61 (1987). Herein, by use of a test unit (Bristow test machine) described above, a contact time is set at 0.5 sec to measure and, at the time of measurement, a slit width of a head box of the Bristow test unit is controlled adapted to the surface tension of ink. Furthermore, the ink strike-through is eliminated from calculation.

—pH—

In the second layer, the pH of the layer surface is preferably controlled to 4 or less, thereby, the imparted ink is coagulated to result in an improvement in ink fixing. That is, in the case of ink that contains for instance a pigment as a coloring component, when the ink strikes the second layer, the pigment is coagulated owing to a variation of the pH to be able to inhibit the ink from blurring with time and the color mixing between colors from occurring.

Examples of compounds that make a surface of the second layer acidic include compounds that have a phosphoric acid group, a phosphonic acid group, a phosphinic acid group, a sulfuric acid group, a sulfonic acid group, a sulfinic acid group or a carboxylic acid group or a group derived from the salt thereof, a compound having a phosphoric acid group or a carboxylic acid group being preferably used.

Examples of compounds that have a phosphoric acid group include phosphoric acid, polyphosphoric acid or derivatives of compounds thereof, or salts thereof. Examples of compounds that have a carboxylic acid group include compounds that have a furan, pyrrole, pyrroline, pyrolidone, pyrone, pyrrole, thiophene, indole, pyridine or quinoline structure and further have a carboxyl group as a functional group such as pyrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives thereof, or salts thereof.

When one of the compounds is added to a film-forming solution for the second layer, the pH may be controlled to 4 or less. An addition amount may well be appropriately selected so that the pH may be 4 or less.

The pH is measured according to an A method (coating method) of methods for measuring the film surface pH, which is determined by Japan Technical Association of the Pulp and Paper Industry (J. TAPPI), and a method that corresponds to, for instance, the A method and uses a paper surface pH measurement set "Form MPC" (trade name, manufactured by Kyoritsu Chemical-Check Lab., Corp.) is used to measure. In the form MPC, a test liquid is spread on a paper surface and a color thereof is compared with a reference color to measure.

A thickness of the second layer is preferably from 3 to 50 μm and more preferably from 4 to 40 μm. When the thickness of the second layer is within the range, the image blurring and color mixing between colors are preferably inhibited from occurring.

(Other Layer)

In the recording medium of the invention, other layers other than the first and second layers may be disposed as the other layer. The other layer may be appropriately selected according to the object.

<Producing Method of Recording Medium>

The recording medium of the invention, as far as it is produced so as to have a layer structure where a first layer and a second layer are laminated sequentially from a base paper side on the base paper, is not particularly restricted in the producing method. However, the recording medium of the invention is preferably produced according to a method (producing method of a recording medium of the invention) that includes a first forming step where, on a base paper, a film-forming solution containing thermoplastic resin particles is provided, followed by heating in a temperature region equal to or more than the minimum film-forming temperature of the thermoplastic resin particles to form a first layer; and a second forming step where, on the first layer, a film-forming solution containing a white pigment and at least one kind selected from a group made of a urethane resin and an acrylic resin, which have the glass transition temperature of 50° C. or less, is provided to form a second layer. The producing method of the recording medium of the invention may further include, as needs arise, appropriately selected other steps.

—First Forming Step—

In the first forming step, on a base paper, a film-forming solution (film-forming solution for forming a first layer) containing thermoplastic resin particles is provided, followed by heating in a temperature region equal to or more than the minimum film-forming temperature of the thermoplastic resin particles to form a first layer. In the heating step, pressure may be applied.

Details of the base paper are same as that mentioned above and a preferable aspect as well is same.

Examples of the thermoplastic resins and particles thereof include ones same as the thermoplastic resins capable of using in the first layer and latexes thereof without particular restriction. The thermoplastic resin particles may be used singularly or in a combination of two or more kinds thereof.

As the thermoplastic resin particles, from the viewpoint of the water resistance, at least one kind selected from a group made of urethane resin latex and acrylic resin latex is preferred.

As the thermoplastic resin particles, one having an average particle diameter from 10 to 200 nm is preferred. Herein, the average particle diameter of the thermoplastic resin particles is a value measured by use of a dynamic light scattering method (device name: ELS-800, manufactured by OTSUKA ELECTRONICS CO., LTD.).

Furthermore, a thermoplastic resin that constitutes the thermoplastic resin particles preferably has the minimum film-forming temperature (MFT) in the range of 5 to 60° C.

A coating amount of the thermoplastic resin is preferably in the range of 1 to 30 g/m$^2$.

The thermoplastic resin particle preferably contains, from the viewpoint of suppression of cockling, an improvement in the temporal blurring and production aptitude, dispersion particles of water-dispersible latex. The water-dispersible latex is one where a hydrophilic polymer insoluble or difficult to dissolve in water is dispersed as fine particles in an aqueous phase. As the dispersion state, any one of one where a polymer is emulsified in a dispersion medium, one obtained by emulsion polymerization, one obtained by micelle dispersion or one where a polymer molecule partially has a hydrophilic structure and a molecular chain per se is dispersed molecule-like may be used. The water-dispersible latexes are detailed in "Gosei Jushi Emulsion (Synthetic Resin Emulsion)", edited by Taira Okuda and Hiroshi Inagaki, published by Kobunshi Kankokai (1978); "Gosei Latex no Oyo (Application of Synthetic Latexes)", edited by Takaaki Sugimura, Yasuo Kataoka, Soichi Suzuki and Keiji Kasahara, published by Kobunshi Kankokai (1993); and "Gosei Latex no Kagaku (Chemistry of Synthetic Latexes)", written by Soichi Muroi, published by Kobunshi Kankokai (1970).

A disposing method of the film-forming solution for the first layer, as far as it is capable of forming a film, is applied without particular restriction. Examples thereof include arbitrary known methods such as a coating method, an inkjet method or a dipping method. From the viewpoint of the smoothness of a film surface after film formation, a coating method that uses a film-forming solution for the first layer as a coating solution is preferred.

As the coating method, a known coating method may be applied. Examples of the known coating methods include a blade coating method, a slide bead method, a curtain method, an extrusion method, an air knife method, a roll coating method and a rod bar coating method.

After coating, a coated film is heated in a temperature region equal to or more than the minimum film-forming temperature of the thermoplastic resin. The heating step may combine a drying step after coating or may be applied separately. The heating step is carried out according to a method where a work is put in an oven set at a temperature of the minimum film-forming temperature or more or a method where a drying air having a temperature equal to or more than the minimum film-forming temperature is blown.

—Second Forming Step—

In the second forming step, on the first layer formed in the first forming step, a film-forming solution containing a white pigment and at least one kind selected from a group made of a urethane resin and an acrylic resin, which have the glass transition temperature of 50° C. or less, is provided to form a second layer. Except that a second layer is formed on the first layer, there is no particular restriction; accordingly, appropriate selection may be applied depending on the object.

A disposing method of the film-forming solution for the second layer, as far as it is capable of forming a film, is applied without particular restriction. Examples thereof include arbitrary known methods such as a coating method, an inkjet method or a dipping method. From the viewpoint of capable of obtaining a smooth and highly glossy film surface after film formation, a coating method that uses a film-forming solution for the second layer as a coating solution is preferred.

As the coating method, a known coating method may be applied. Examples of the known coating methods include a blade coating method (bent method, bevel method), a slide bead method, a curtain method, an extrusion method, an air knife method, a roll coating method and a rod bar coating method. Among these, from the viewpoint of being capable of coating at a high-speed and of being capable of obtaining the glossiness by accelerating an orientation when a flat plate pigment such as a layered inorganic compound is used, a blade coating method is preferred. Furthermore, in the blade coating method, at the moment of scraping, relatively large shearing stress is generated; accordingly, due to pressure permeation due to instantaneous nip pressure, a large amount of water tends to move into a paper support. However, the blade coating method is particularly effective in the recording medium of the invention, which is provided with the first layer that blocks a solvent from permeating.

Other than the above-mentioned step, without particular restriction, other step may be disposed. The other step may be appropriately selected depending on the object.

<Inkjet Recording Method>

An inkjet recording method of the invention may be constituted by disposing an ink drawing step where ink is provided to the recording medium of the invention to perform ink drawing in accordance with predetermined image data and a drying and removing step where an ink solvent in the ink drawn recording medium is dried and removed.

Figure 2:
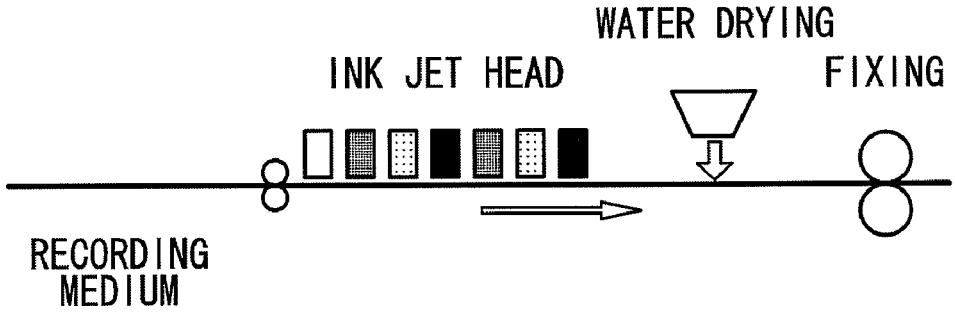
FIG. 2 is an explanatory diagram for explaining an example of an inkjet recording method involving a first aspect that uses a recording medium of the invention.

As an example of an inkjet recording method of the invention, an inkjet recording method (see FIG. 2; hereinafter, referred to as an "inkjet recording method involving the first aspect") that applies the ink drawing to, among the recording media of the invention, a recording medium in which a coagulant (treatment solution) is previously added in the second layer (coated layer on the first layer) to lower the pH of a layer surface, and an inkjet recording method (see FIG. 3; hereinafter, referred to as a "inkjet recording method involving the second aspect") where, after a treatment solution containing an acidic substance is fed (pre-coat) to the recording medium of the invention, the ink drawing is applied are cited.

An inkjet recording method involving the first exemplary embodiment of the invention is constituted by including an ink drawing step where ink is provided to a recording medium of the invention where the pH of a layer surface of the second layer is controlled to 4 or less to perform ink drawing in accordance with predetermined image data and a drying and removing step where an ink solvent in the ink drawn recording medium is dried to remove.

Furthermore, an inkjet recording method involving the second aspect of the invention is constituted by including a treatment solution feed step where a treatment solution containing an acidic substance is fed to the recording medium of the invention, an ink drawing step where ink is provided to the recording medium to which the treatment solution is fed to perform ink drawing in accordance with predetermined image data and a drying and removing step where an ink solvent in the ink drawn recording medium is dried to remove.

All of the inkjet recording methods involving the first and second aspects may, as needs arise, contain appropriately selected other step.

—Ink Drawing Step—

In the ink drawing step of the first aspect, among the recording media mentioned above, a recording medium of the invention where a layer surface of the second layer is controlled to the pH of 4 or less is used, and ink is provided to the second layer of the recording medium to perform ink drawing in accordance with predetermined image data. When the ink (such as pigment ink) is provided to the second layer, the ink (such as pigment in ink) is coagulated owing to the pH variation at the time of ink striking to inhibit the ink from causing the blurring and color mixing between colors.

In the ink drawing step of the second aspect, without controlling the pH of a layer surface of the second layer to 4 or less or with the pH controlling like the first aspect, ink is provided to a recording medium to which a treatment solution is fed in the treatment solution feed step described below to perform the ink drawing in accordance with predetermined image data. In the second aspect, before the ink is provided or at the same time with the ink provision, the second layer is at least partially rendered acidic (preferably pH is 4 or less) due to the treatment solution fed to the second layer; accordingly, the ink (such as pigment ink) provided thereto undergoes a pH variation at the time of droplet impact to coagulate to inhibit the ink from causing the blurring and color mixing between colors.

The ink drawing step has no particular restriction other than drawing is carried out by providing ink in accordance with the predetermined image data and may be appropriately selected in accordance with the object. For instance, ink is discharged by use of an inkjet method to perform the ink drawing. The inkjet recording method is not particularly restricted and any one of an electric charge control method where ink is discharged by making use of force of electrostatic attraction, a drop-on demand method (pressure pulse method) that makes use of vibration pressure of a piezo device, an acoustic inkjet method where an electric signal is converted into an acoustic beam to illuminate ink and by making use of radiation pressure ink is discharged and a thermal inkjet method where ink is heated to generate foams to make use of generated pressure may be used. The inkjet recording method includes a method where ink called a photo-ink and low in a concentration is discharged a lot in small volume, a method where a plurality of inks substantially same in hue and different in the concentration is used to improve image quality and a method where colorless transparent ink is used.

Among the methods, a drop-on demand method (pressure pulse method) that uses a piezo device is preferred.

—Treatment Solution Feed Step—

In the inkjet recording method involving the second aspect, before the ink drawing step, a treatment solution feed step is disposed to feed a treatment solution containing an acidic substance in advance to the second layer of the recording medium. The treatment solution applying step is not particularly restricted other than applying a treatment solution containing the acid substance described below and may be appropriately selected depending on the object. Furthermore, the treatment solution feed step may be provided, as needs arise, to the inkjet recording method involving the first aspect.

(Treatment Solution)

A treatment solution containing an acidic substance may well be a liquid controlled so as to have a liquid property on an acidic side by containing an acidic substance and an aqueous treatment solution obtained by mixing an acidic substance and an aqueous solvent is preferred. The pH of the treatment solution in the invention is, from the viewpoint of inhibiting the ink from causing blurring and color mixing between colors, preferably 4 or less.

Examples of the acidic substances that render the treatment solution acidic include compounds having a group such as a phosphoric acid group, a phosphonic acid group, a phosphinic acid group, a sulfuric acid group, a sulfonic acid group, a sulfinic acid group and a carboxylic acid group or a group derived from the salt thereof, a compound having a phosphoric avid group or a carboxylic acid group being preferred and a compound having a carboxylic acid group being more preferred.

Examples of compounds that have a phosphoric acid group include phosphoric acid, polyphosphoric acid or derivatives of compounds thereof, or salts thereof. Examples of compounds that have a carboxylic acid group include compounds that have a furan, pyrrole, pyrroline, pyrolidone, pyrone, pyrrole, thiophene, indole, pyridine or quinoline structure and has a carboxyl group as a functional group such as pyrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives of compounds thereof, or salts thereof. One of these is added to the treatment solution.

Furthermore, preferable examples of the acidic substances include pyrolidone carboxylic acid, pyrone carboxylic acid, furan carboxylic acid, coumaric acid or a compound derivative thereof or a salt thereof. The acidic substances may be used singularly or in a combination of two or more kinds thereof.

The treatment solution may contain, within a range that does not damage advantages of the invention, other additives.

Examples of the other additives include known additives such as a drying inhibitor (wetting agent), a discoloring inhibitor, an emulsion stabilizer, a permeation accelerator, a UV absorber, an antiseptic, a mold inhibitor, a pH adjusting agent, a surface tension adjusting agent, a defoaming agent, a viscosity adjuster, a dispersing agent, a dispersion stabilizer, a rust inhibitor or a chelating agent.

The treatment solution may be fed over an entirety of a recording surface of the recording medium or at least partially on a recording surface such as in accordance with predetermined image data. Furthermore, a method of applying the treatment solution is not particularly restricted. A coating method, an inkjet method and a dipping method are cited. For instance, the inkjet method may be used to discharge the treatment solution to feed.

Furthermore, in the inkjet recording method involving the second aspect, aqueous two liquid coagulating ink described below may be used to draw.

—Drying and Removing Step—

In the drying and removing step, an ink solvent in the ink drawn recording medium is dried to remove. There is no particular restriction except that an ink solvent of the ink provided to the recording medium is dried to remove; accordingly, an appropriate selection may be applied depending on the object.

The drying and removing step is applied, since a coated layer as the second layer is mildly permeative in the recording medium of the invention, in a state where an ink solvent (water in particular) is present in the proximity of a surface of the recording medium. The drying and removing step may be applied according to a method where a dry air heated at a predetermined temperature is blown or a method where the recording medium is passed through between a pair of heated and/or pressurized rolls.

—Other Step—

The inkjet recording method of the invention may be provided with, in addition to the above-mentioned steps, other steps. The other step is not particularly restricted and may be appropriately selected depending on the object. For instance, a heating and fixing step is cited.

In the inkjet recording method of the invention, after the drying and removing step, for instance, a heating and fixing step for melting and fixing latex particles contained in the ink used in the inkjet recording method may be disposed. According to the heating and fixing step, the fixability of the ink to the recording medium may be enhanced. The heating and fixing step is not particularly restricted except for the melting and fixing as mentioned above and may be appropriately selected depending on the object.

—Example of Aspect of First Inkjet Recording Method—

In the first inkjet recording method, for instance, under the conditions described below, ink drawing, drying (water drying, air blow drying) and heating and fixing are carried out.

<Ink Drawing>

Head: 1,200 dpi/20 inch width full-line head

Amount of discharge liquid droplet: four value recording of 0, 2.0, 3.5 and 4.0 pL Drive frequency: 30 kHz (conveying speed of recording medium: 635 mm/sec)

<Drying (Water Drying, Air Blow Drying)>

Speed of wind: 8 to 15 m/s

Temperature: 40 to 80° C.

Air blow region: 640 mm (drying time: 1 sec)

<Heating and Fixing>

Silicone rubber roller (hardness: 50°, nip width: 5 mm)

Roller temperature: 70 to 90° C.

Pressure: 0.5 to 2.0 MPa

—Example of Aspect of Second Inkjet Recording Method—

In the second inkjet recording method, for instance, under the conditions described below, pre-coating, ink drawing, drying (water drying, air blow drying) and heating and fixing are carried out.

<Head for Treating Solution for Pre-coat Module>

Head: 600 dpi/20 inch width full-line head

Amount of discharge liquid droplet: two value recording of 0 and 4.0 pL

Drive frequency: 15 kHz (conveying speed of recording medium: 635 mm/sec)

Drawing pattern: in the ink drawing step, a pattern by which at a position where color ink having at least one color is drawn, a treatment solution is provided in advance is applied <Water-drying (Air Blow Drying) for Pre-Coat Module>

Speed of wind: 8 to 15 m/s

Temperature: 40 to 80° C.

Air blow region: 450 mm (drying time: 0.7 sec)

<Ink Drawing>

Head: 1,200 dpi/20 inch width full-line head

Amount of discharge liquid droplet: four value recording of 0, 2.0, 3.5 and 4.0 pL Drive frequency: 30 kHz (conveying speed of recording medium: 635 mm/sec)

<Drying (Water Drying, Air Blow Drying)>

Speed of wind: 8 to 15 m/s

Temperature: 40 to 80° C.

Air blow region: 640 mm (drying time: 1 sec)

<Heating and Fixing>

Silicone rubber roller (hardness: 50°, nip width: 5 mm)

Roller temperature: 70 to 90° C.

Pressure: 0.5 to 2.0 MPa

~Aqueous Two-liquid Coagulating Ink~

In the inkjet recording method involving the second aspect, aqueous two liquid coagulating ink including a treatment solution and ink that reacts with the treatment solution to coagulate may be used.

As the treatment solution of the aqueous two liquid coagulating ink, one similar to the above-mentioned treatment solution may be used. Details of the treatment solution are as mentioned above.

—Ink—

The ink which constitutes aqueous two-liquid coagulating ink system can be used in not only monochromatic image formation, but full color image formation. To form a full color image, a magenta tone ink, a cyan tone ink and a yellow tone ink can be used, and to adjust the tone, a black tone ink may further be used. Furthermore, other than the yellow, magenta and cyan tone inks, red, green, blue and white color inks and so-called specific color inks in printing filed (for example, colorless) can be used.

Furthermore, as the ink, one that contains, for instance, latex particles, an organic dye, a dispersing agent and an aqueous organic solvent, and, as needs arise, further contains other additives is cited.

<Latex Particles>

As the latex particles, particles of a polymer of a compound made of, for instance, a nonionic monomer, an anionic monomer or a cationic monomer, which is dispersed in an aqueous medium, are cited.

The nonionic monomer means a monomer compound that does not have a dissociative functional group. The monomer compound means in the broad sense a polymerizable compound alone or a compound that polymerizes with another compound. As the monomer compound, a monomer compound having an unsaturated double bond is cited.

The anionic monomer means a monomer compound that contains an anionic group capable of having a minus charge. The anionic group, as far as it has a minus charge, may be any one, and preferable examples thereof include a phosphoric acid group, a phosphonic acid group, a phosphinic acid group, a sulfuric acid group, a sulfonic acid group, a sulfinic acid group and a carboxylic acid group, a phosphoric acid group and a carboxylic acid group being more preferred, and a carboxylic acid group being further more preferred.

The cationic monomer means a monomer containing a cationic group capable of having a plus charge. The cationic group, as far as it has a plus charge, may be any one. However, an organic cationic substituent is preferred and a cationic group of nitrogen or phosphorus is more preferred. Furthermore, a pyridinium cation or ammonium cation is more preferred.

<Organic Pigments>

Examples of the organic pigment for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 128, C.I. Pigment Yellow 138, C.I. Pigment Yellow 151, C.I. Pigment Yellow 155, C.I. Pigment Yellow 180 and C.I. Pigment Yellow 185.

Examples of the organic pigment for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222 and C.I. Pigment Violet 19.

Examples of the organic pigment for green or cyan include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Green 7, and siloxane-crosslinked aluminum phthalocyanine described in U.S. Pat. No. 4,311,775.

Examples of the organic pigment for black include C.I. Pigment Black 1, C.I. Pigment Black 6 and C.I. Pigment Black 7.

Furthermore, an average particle diameter of an organic pigment is preferred to be smaller from the viewpoint of the transparency and color reproducibility and preferred to be larger from the viewpoint of the light resistance. An average particle diameter that combines these requirements is preferably from 10 to 200 nm, more preferably from 10 to 150 nm and still more preferably from 10 to 100 nm. Still furthermore, a particle size distribution of the organic pigment is not restricted to particular one. Any one of one that has a broad particle size distribution and one that has a mono-disperse particle size distribution may be used. Furthermore, two or more kinds of organic pigments having a mono-disperse particle distribution may be mixed and used.

Furthermore, an addition amount of the organic pigment is, relative to the ink, preferably from 1 to 25% by mass, more preferably from 2 to 20% by mass, still more preferably from 5 to 20% by mass and particularly preferably from 5 to 15% by mass.

<Dispersant>

The dispersant for the organic pigment may be a polymer dispersant, or a low molecular surfactant type dispersant. The polymer dispersant may be either one of a water-soluble dispersant or a water-insoluble dispersant.

The low molecular surfactant type dispersant can be added for the purpose of stably dispersing the organic pigment in a water solvent while maintaining an ink in low viscosity. The low molecular dispersant used herein means a low molecular dispersant having a molecular weigh of 2,000 or lower. The molecular weight of the low molecular dispersant is preferably from 100 to 2,000, and more preferably from 200 to 2,000.

The low molecular dispersant has a structure containing a hydrophilic group and a hydrophobic group. At least one of each of the hydrophilic group and the hydrophobic group may be independently contained in one molecule, and the low molecular dispersant may have plural kinds of the hydrophilic group and the hydrophobic group. The low molecular dispersant can appropriately have a linking group for linking the hydrophilic group and the hydrophobic group.

Examples of the hydrophilic group include an anionic group, a cationic group, a nonionic group, and a betaine type combining those.

The anionic group is not particularly limited so long as it has a negative charge. A phosphoric acid group, a phosphonic acid group, a phosphinic acid group, a sulfuric acid group, a sulfonic acid group, a sulfinic acid group and a carboxylic acid group are preferred, a phosphoric acid group and carboxylic acid group are more preferred, and a carboxylic acid group is further preferred. The cationic group is not particularly limited so long as it has a positive charge. An organic cationic substituent is preferred, a cationic group containing nitrogen or phosphorus is more preferred. Above all, pyridinium cation and ammonium cation are particularly preferred.

Examples of the nonionic group include polyethylene oxide, polyglycerin and a part of sugar unit It is preferred in the invention that the hydrophilic group is an anionic group from the standpoints of dispersion stability and aggregation properties of a pigment. A phosphoric acid group, a phosphonic acid group, a phosphinic acid group, a sulfuric acid group, a sulfonic acid group, a sulfinic acid group and a carboxylic acid group are preferred as the anionic group, a phosphoric acid group and carboxylic acid group are more preferred, and a carboxylic acid group is further preferred.

When the low molecular dispersant has an anionic hydrophilic group, its pKa is preferably 3 or more from the standpoint of accelerating an aggregation reaction by contacting with an acidic treating liquid. The pKa of the low molecular dispersant in the invention is a value experimentally obtained from a titration curve by titrating a liquid obtained dissolving 1 mmol/liter of a low molecular dispersant in a tetrahydrofuran-water=3:2 (V/V) solution, with an acid or alkali aqueous solution.

Theoretically, when pKa of a low molecular weight dispersant is 3 or more, 50% or more of anionic groups are in a non-dissociation state when contacted with a treating liquid having a pH of about 3. Therefore, water solubility of the low molecular weight dispersant is remarkably decreased, and an aggregation reaction occurs. In other words, aggregation reactivity is improved. From this standpoint, it is preferred that the low molecular dispersant has a carboxylic acid group as an anionic group.

The hydrophobic group may have any structure of hydrocarbon type, fluorocarbon type, silicone type and the like, and the hydrocarbon type is particularly preferred. Those hydrophobic groups may have any of a linear structure and a branched structure. The hydrophobic group may have one chain structure or two or more chain structure. Where the structure has two or more chains, the structure may have plural kinds of hydrophobic groups. The hydrophobic group is preferably a hydrocarbon group having 2 to 24 carbon atoms, more preferably a hydrocarbon group having 4 to 24 carbon atoms, further preferably a hydrocarbon group having 6 to 20 carbon atoms.

Among the polymer dispersants, a hydrophilic polymer compound can be used as the water-soluble dispersant. Examples of a natural hydrophilic polymer compound include vegetable polymers such as gum Arabic, gum tragacanth, gum guar, gum karaya, locust bean gum, arabinogalactan, pectin and quince seed starch; seaweed polymers such as alginic acid, carrageenan and agar; animal polymers such as gelatin, casein, albumin and collagen; and microbial polymers such as xanthene gum and dextran.

Examples of a modified hydrophilic polymer compound using a natural product as a raw material include cellulose polymers such as methyl cellulose, ethyl cellulose, hydroxyethyl cellulose, hydroxypropyl cellulose and carboxymethyl cellulose; starch polymers such as starch sodium glycolate and starch sodium phosphate ester; and seaweed polymers such as sodium alginate, propylene glycol alginate ester.

Examples of a synthetic water-soluble polymer compound include vinyl polymers such as polyvinyl alcohol, polyvinyl pyrrolidone and polyvinyl methyl ether; acrylic resins such as non-crosslinked polyacrylamide, polyacrylic acid or its alkali metal salt, and water-soluble styrene acrylic resin; water-soluble styrene maleic acid resins; water-soluble vinylnaphthalene acrylic resins; water-soluble vinylnaphthalene maleic resins; polyvinyl pyrrolidone, polyvinyl alcohol, alkali metal salts of β-naphthalenesulfonic acid formalin condensate; polymer compounds having a salt of a cationic functional group such as quaternary ammonium or amino group at a side chain; and natural polymers such as shellac.

Among these, one obtained by introducing a carboxyl group like one made of a homopolymer of acrylic acid or methacrylic acid or a copolymer of acrylic acid or methacrylic acid with styrene or a monomer that has other hydrophilic group is particularly preferred as a polymer dispersing agent.

Of the polymer dispersants, as a non-water-soluble dispersant, a polymer having both a hydrophilic moiety and a hydrophobic moiety may be used. Examples of such a polymer include styrene-(meth)acrylic acid copolymer, styrene-(meth)acrylic acid-(meth)acrylic acid ester copolymer, (meth)acrylic acid ester-(meth)acrylic acid copolymer, polyethylene glycol (meth)acrylate-(meth)acrylic acid copolymer, vinyl acetate-maleic acid copolymer and styrene-maleic acid copolymer.

The polymer dispersant used in the invention has a weight average molecular weight of preferably from 3,000 to 100,000, more preferably from 5,000 to 50,000, further preferably from 5,000 to 40,000, and particularly preferably from 10,000 to 40,000.

Mixing mass ratio of an organic pigment and a dispersant (pigment:dispersant) is preferably in a range of from 1:0.06 to 1:3, more preferably in a range of from 1:0.125 to 1:2, and further preferably in a range of from 1:0.125 to 1:1.5.

(Water-Soluble Organic Solvent)

The water-soluble organic solvent can be contained as a drying inhibitor or a permeation accelerator.

Where the water-based ink composition of the invention is particularly applied to an image recording method by an inkjet method, the drying inhibitor can effectively prevent clogging of nozzle that may possibly be generated by drying of an ink at an ink jet orifice.

The drying inhibitor is preferably a water-soluble organic solvent having vapor pressure lower than that of water. Specific examples of the drying inhibitor include polyhydric alcohols such as ethylene glycol, propylene glycol, diethylene glycol, polyethylene glycol, thiodiglycol, dithiodiglycol, 2-methyl-1,3-propanediol, 1,2,6-hexanetriol, acetylene glycol derivatives, glycerin and trimethylolpropane; lower alkyl ethers of polyhydric alcohol, such as ethylene glycol monomethyl (or ethyl) ether, diethylene glycol monomethyl (or ethyl) ether and triethylene glycol monoethyl (or butyl) ether; heterocycles such as 2-pyrrolidone, N-methyl-2-pyrrolidone, 1,3-dimethyl-2-imidazolidinone and N-ethylmorpholine; sulfur-containing compounds such as sulfolane, dimethylsufoxide and 3-sulforene; polyfunctional compounds such as diacetone alcohol and diethanolamine; and urea derivatives. Above all, polyhydric alcohols such as glycerin and diethylene glycol are preferred as the drying inhibitor. Those drying inhibitors may be used alone or as mixtures of two kinds or more thereof. Those drying inhibitors are preferably contained in an amount of from 10 to 50% by mass in the ink.

The water-soluble organic solvent as the permeation accelerator is preferably used for the purpose of well permeating the ink into a recording medium (printing paper). Specific examples of the permeation accelerator include alcohols such as ethanol, isopropanol, butanol, di(tri)ethylene glycol monobutyl ether and 1,2-hexanediol; sodium lauryl sulafate, sodium oleate and nonionic surfactants. When the permeation accelerator is contained in the ink composition in an amount of from 5 to 30% by mass, sufficient effect is exhibited. The permeation accelerator is preferably used within a range of the addition amount such that bleeding of printing and print-through are not generated.

The water-soluble organic solvent can be used to adjust viscosity, other than the above. Specific examples of the water-soluble organic solvent that can be used to adjust viscosity include alcohols (for example, methanol, ethanol, propanol, isopropanol, butanol, isobutanol, sec-butanol, t-butanol, pentanol, hexanol, cyclohexanol and benzyl alcohol), polyhydric alcohols (for example, ethylene glycol, diethylene glycol, triethylene glycol, polyethylene glycol, propylene glycol, dipropylene glycol, polypropylene glycol, butylene glycol, hexanediol, pentanediol, glycerin, hexanetriol and thiodiglycol), glycol derivatives (for example, ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether and ethylene glycol monophenyl ether), amines (for example, ethanolamine, diethanolamine, triethanolamine, N-methyl diethanolamine, N-ethyl diethanolamine, morpholine, N-ethylmorpholine, ethylene diamine, diethylene triamine, triethylene tetramine, polyethylene imine and tetramethylpropylene diamine), and other polar solvents (for example, formaldehyde, N,N-dimethylformamide, N,N-dimethylacetamide, diemthylsulfoxide, sulfolane, 2-pyrrolidone, N-methyl-2-pyrrolidone, N-vinyl-2-pyrrolidone, 2-oxazolidone, 1,3-dimethyl-2-imidazolidinone, acetonitrile and acetone).

The water-soluble organic solvent may be used alone or as mixtures of two kinds or more thereof.

(Other Additives)

Examples of other additives used in the invention include conventional additives such as drying inhibitor (wetting agent), color fading inhibitor, emulsion stabilizer, permeation accelerator, ultraviolet absorber, preservative, mildew-proofing agent, pH regulator, surface tension regulator, defoamer, viscosity regulator, dispersant, dispersion stabilizer, anti-rust agent and chelating agent.

The various kinds of the additives, in the case of an aqueous ink, are added directly to the ink. In the case where an oil-soluble dye is used in the form of a dispersion, it is general that, after a dye dispersion is prepared, the additive is added to the dispersion. However, during preparation of the dye dispersion, the additive may be added to an oil phase or an aqueous phase.

The ultraviolet absorber is used for the purpose of improving preservability of an image. The ultraviolet absorber can use benzotriazole compounds described in, for example, JP-A Nos. 58-185677, 61-190537, 2-782, 5-197075 and 9-34057; benzophenone compounds described in, for example, JP-A Nos. 46-2784 and 5-194483, and U.S. Pat. No. 3,214,463; cinnamic acid compounds described in, for example, JP-B Nos. 48-30492 and 56-21141, and JP-A No. 10-88106; triazine compounds described in, for example, JP-A Nos. 4-298503, 8-53427, 8-239368 and 10-182621, and JP-A No. 8-501291; compounds described in Research Disclosure No. 24239; and compounds that absorb ultraviolet light and emit fluorescence, i.e., fluorescent brighteners, represented by stilbene compounds or benzoxazole compounds.

The color fading inhibitor is used for the purpose of improving storability of an image. Examples of the color fading inhibitor that can be used include various organic color fading inhibitors and metal complex color fading inhibitors. Examples of the organic color fading inhibitor include hydroquinones, alkoxyphenols, dialkoxyphenols, phenols, anilines, amines, indanes, chromanes, alkoxyanilines and heterocycles. Examples of the metal complex color fading inhibitor include a nickel complex and a zinc complex. More specifically, compounds described in the patents cited in Research Disclosure No. 17643, chapter VII, items I to J; Research Disclosure No. 15162: Research Disclosure No. 18716, page 650, the left-hand column; Research Disclosure No. 36544, page 527; Research Disclosure No. 307105, page 872; and Research Disclosure No. 15162, and compounds included in the formulae of the representative compounds and the exemplified compounds described on pages 127 to 137 of JP-A No. 62-215272 can be used.

Examples of the mildew-proofing agent include sodium dehydroacetate, sodium benzoate, sodium pyridinethion-1-oxide, p-hydroxybenzoic acid ethyl ester, 1,2-benzisothiazolin-3-one and its salt. Those are preferably used in the ink composition in an amount of from 0.02 to 1.00% by mass.

As the pH regulator, a neutralizer (organic base and inorganic alkali) may be used. The pH regulator may be added in an amount such that the inkjet ink composition has pH of preferably from 6 to 10, and more preferably from 7 to 10, for the purpose of improving storage stability of the inkjet ink composition.

Examples of the surface tension regulator include nonionic surfactants, cationic surfactants, anionic surfactants and betaine surfactants.

The surface tension regulator is added in an amount such that the surface tension of the ink composition is adjusted to preferably from 20 to 60 mN/m, more preferably from 20 to 45 mN/m, and further preferably from 25 to 40 mN/m, in order to well eject the ink composition by an inkjet method.

Specific examples of the surfactant as a hydrocarbon type preferably include anionic surfactants such as fatty acid salts, alkyl sulfate ester salts, alkyl benzene sulfonates, alkyl naphthalene sulfonates, dialkyl sulfosuccinates, alkyl phosphate ester salts, naphthalenesulfonic acid-formalin condensates and polyoxyethylene alkyl sulfate ester salts; and nonionic surfactants such as polyoxyethylene alkyl ether, polyoxyethylene alkyl allyl ether, polyoxyethylene fatty acid ester, sorbitan fatty acid ester, polyoxyethylene sorbitan fatty acid ester, polyoxyethylene alkyl amine, glycerin fatty acid ester and oxyethylene oxypropylene block copolymer. SURFYNOLS (trade name, products of Air Products & Chemicals) which are an acetylene type polyoxyethylene oxide surfactant are preferably used. Furthermore, amine oxide type amphoteric surfactants such as N,N-dimethyl-N-alkyl amine oxide are preferred.

Additionally, materials described on pages (37) to (38) of JP-A No. 59-157636 and Research Disclosure No. 308119 (1989) as surfactants can be used.

When fluorine (alkyl fluoride type) surfactants, silicone surfactants and the like, such as those described in JP-A Nos. 2003-322926, 2004-325707 and 2004-309806 are used, scratch fastness can be improved.

The surface tension regulator can be used as a defoamer, and fluorine compounds, silicone compounds, chelating agents represented by EDTA, and the like can be used.

EXAMPLES

In what follows, the present invention will be more specifically described with reference to examples. However, the invention, as far as it does not exceed the gist thereof, is not restricted to examples shown below. Herein, unless stated clearly, "part" and "%" are based on mass and "degree of polymerization" expresses an "average degree of polymerization".

Example 1

Preparation of Inkjet Recording Medium (Preparation of Film-Forming Solution for First Layer)

In the beginning, 100 parts of kaolin (trade name: KAOBRIGHT 90, manufactured by SHIRAISHI CALCIUM KAISHA, LTD.), 3.8 parts of 0.1 N sodium hydroxide (Wako Pure Chemical Industries, Limited), 1.2 parts of 40% sodium polyacrylate (trade name: ARON T-50, manufactured by TOAGOSEI CO., LTD.) and 48.8 parts of water were mixed and dispersed by use of a non-bubbling kneader (trade name: NBK-2, manufactured by Nippon Seiki Co., Ltd.), thereby, a 65% kaolin dispersion was obtained. In the next place, to 100 parts of 22.5% urethane latex aqueous dispersion (glass transition temperature: 49° C., the minimum film-forming temperature: 29° C.; trade name: HYDRAN AP-40F, manufactured by DIC Corporation), 5 parts of water, 6.9 parts of the resulting 65% kaolin dispersion and 0.8 parts of 10% Emulgen 109P (trade name, manufactured by KAO CORPORATION) were added, followed by thoroughly agitating and mixing, further followed by maintaining a resulting mixed solution at a liquid temperature from 15 to 25° C., thereby a 24.0% film-forming solution for forming a first layer was obtained.

(Preparation of Film-forming Solution for Second Layer)

In the beginning, 100 parts of kaolin (trade name: KAOBRIGHT 90, manufactured by SHIRAISHI CALCIUM KAISHA, LTD.) and 1.2 parts of 40% sodium polyacrylate (trade name: ARON T-50, manufactured by TOAGOSEI CO., LTD.) were mixed and dispersed in water, followed by adding 62 parts of 22.5% urethane latex aqueous dispersion (glass transition temperature: 49° C., the minimum film-forming temperature: 29° C.; trade name: HYDRAN AP-40F, manufactured by DIC Corporation) and 3.7 parts of an aqueous solution of 10% EMULGEN 109P (trade name, manufactured by KAO CORPORATION), thereby a film-forming solution for the second layer having the final solid concentration of 27% was prepared.

(Formation of First Layer)

On both sides of a high-quality paper (trade name: SIRAOI, manufactured by Nihon Seisi Co., Ltd.) having a basis weight of 81.4 g, an obtained film-forming solution for the first layer was coated on one surface at a time by use of an extrusion die-coater with a dry mass per one surface controlling so as to be 8.0 g/m$^2$, followed by drying at a temperature of 85° C. and a speed of wind of 15 m/sec for 1 min, thereby, a first layer was formed. Furthermore, to the formed first layer, a soft calender treatment shown below was applied. A thickness of the formed first layer was 8.4 μm.

—Soft Calender Treatment—

To a high-quality paper on a surface of which a first layer was formed, by use of a soft calender provided with a roll pair where a metal roll and a resin roll are paired, under conditions of a surface temperature of the metal roll of 50° C. and nip pressure of 50 kg/cm, a soft calender process was applied.

(Formation of Second Layer)

On both sides of a high-quality paper on which the first layer was formed, an obtained film-forming solution for the second layer was coated on one surface at a time by use of an extrusion die-coater with a dry mass per one surface controlling so as to be 30 g/m$^2$, followed by drying at a temperature of 70° C. and a speed of wind of 10 m/sec for 1 min, thereby, a second layer was formed. Similarly to the case of the first layer, a soft calender treatment was applied to the formed second layer. A thickness of the formed second layer was 20.6 μm.

Thus, an inkjet recording medium of the invention was prepared.

(Evaluation)

Resulting inkjet recording medium was subjected to evaluations 1. through 5. below. Evaluation results are shown in Table 1 below.

—1. Cobb Water Absorption Degree Test—

According to the Cobb water absorption degree test based on JIS P8140, at a surface of a first layer of a high-quality paper on which a first layer was formed, the Cobb water absoption degree (a permeating amount of water when water was brought into contact at 20° C. for 120 sec (g/m$^2$)) was measured.

—2. Water Absorption Test after Coating of Second Layer—

Based on the Bristow method, a measurement was carried out as shown below.

Figure 4:
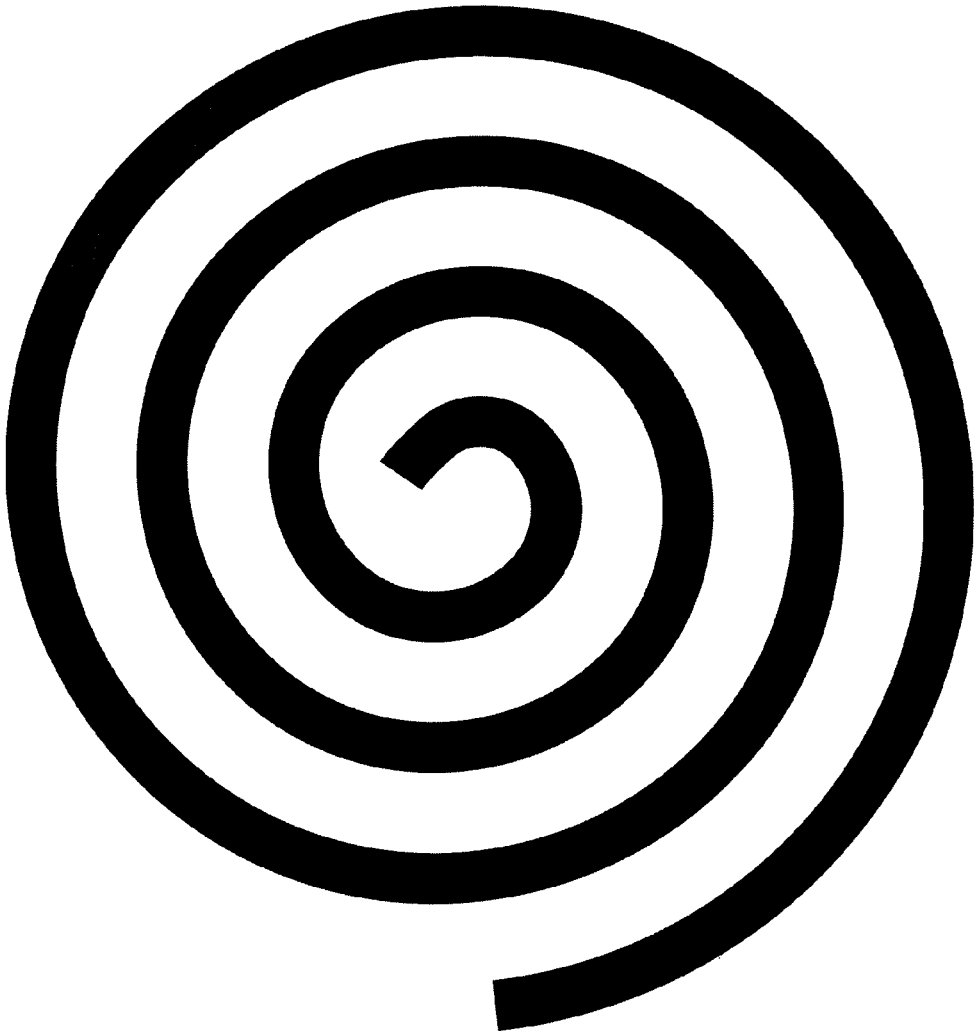
FIG. 4 is a diagram for explaining a scanning line of a head in which a test liquid is filled in the Bristow method.
Figure 5:
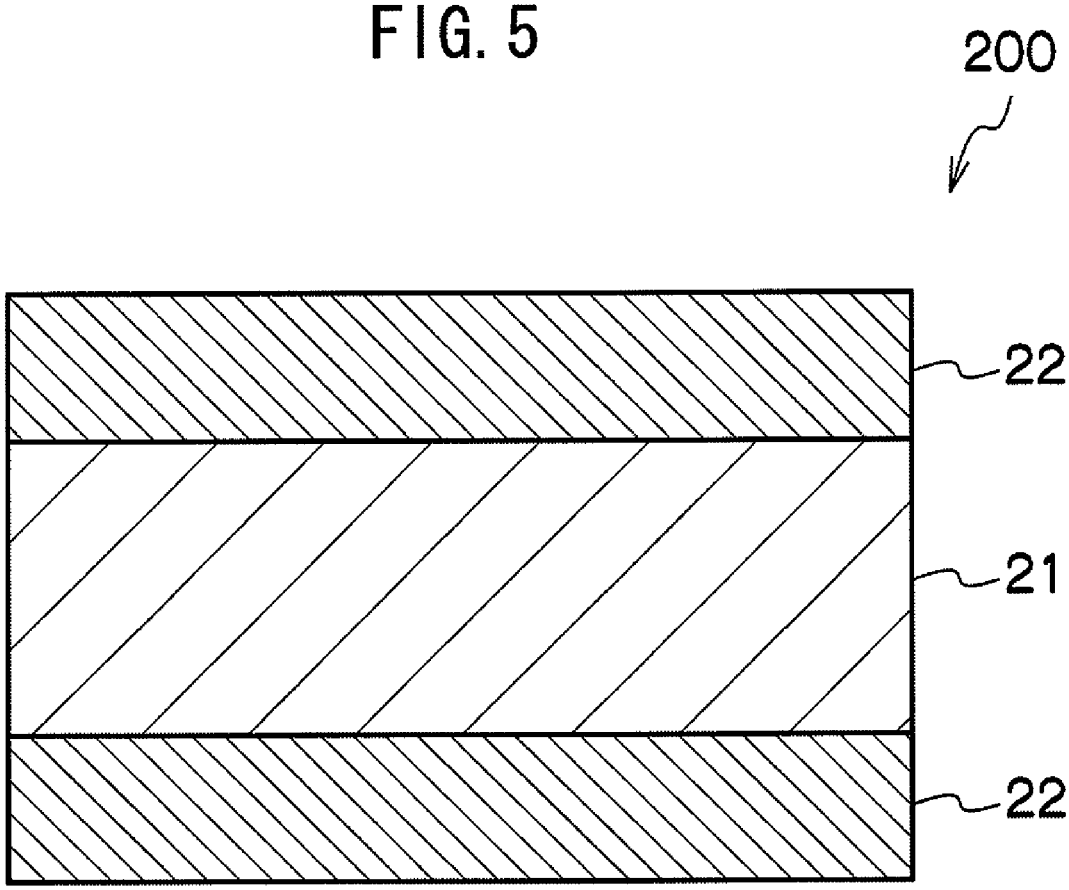
FIG. 5 is a schematic constitutional diagram showing a structure of an existing recording medium.

A sample piece of the second layer obtained by cutting an obtained inkjet recording medium into A6 size was set on a measurement table. After a head filled with a test solution was brought into contact with a disposed sample piece, a scanning line (from inside to outside) as shown in FIG. 4 was automatically scanned to measure the liquid absorption characteristics. By rotating a measurement table with a revolution speed (contact time of paper and ink) varying stepwise, relationship between the contact time and amount of absorbed liquid (amount of absorbed water) was obtained. In Table 1 below, amounts of absorbed water at a contact time of 0.5 sec were shown.

—3. Curl Test—

An inkjet recording medium was cut into a size of 50 mm×50 mm to prepare a test piece, water was coated on the test piece to the respective directions of MD and CD so as to be 10 g/m$^2$, and, based on a curl curvature measurement method stipulated in JAPAN TAPPI Paper and Pulp Test Method No. 15-2: 2000 (Paper-curl Test Method-Second Part), the curling degree when left for 8 hr under environmental conditions of 23° C. and 50% RH was evaluated according to criteria below.

<Evaluation Criteria>

A: The curling degree was less than 10.

B: The curling degree was 10 or more and less than 20.

C: The curling degree was 20 or more and less than 30.

D: The curling degree was 30 or more.

—4. Water Resistance Test—

At 30 sec after water was dropped on the obtained inkjet recording medium, a state of a layer of the inkjet recording medium after water was wiped with a tissue paper was visually evaluated according to evaluation criteria below.

<Evaluation Criteria>

A: A layer was not at all peeled.

B: A layer was partially peeled.

C: The second layer was almost all peeled.

<Preparation of Ink>

(1) Preparation of Cyan Pigment Ink C

—Preparation of Pigment Dispersion—

In the beginning, 10 g of CYANINE BLUE A-22 (PB15:3) (trade name, manufactured by Dainichiseika Color & Chemicals Mfg. Co., Ltd.), 10.0 g of a low molecular weight dispersing agent described below, 4.0 g of glycerin and 26 g of ion exchange water were agitated and mixed to prepare a dispersion. In the next place, the dispersion was intermittently irradiated (irradiation 0.5 sec/non-irradiation 1.0 sec) with ultrasonic wave by use of an ultrasonic irradiation apparatus (VIBRA-CELL VC-750 made by Sonics Inc., tapered microchips: ϕ 5 mm, amplitude: 30%) for two hours to further disperse the pigment therein, thereby a 20% by mass pigment dispersion was prepared.

Low Molecular Weight Dispersing Agent

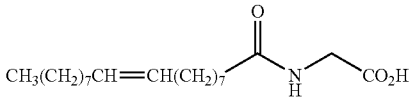

Separately from the pigment dispersion, the compounds shown below were weighed, agitated and mixed to prepare a mixture solution I.

| | |
|---|---|
| glycerin | 5.0 g |
| diethylene glycol | 10.0 g |
| OLFINE E1010 (trade name, manufactured by Nisshin Chemical Industry Co. Ltd.) | 1.0 g |
| ion exchange water | 11.0 g |

The mixture solution I was gradually added dropwise to 23.0 g of a 44% SBR dispersion (polymer fine particles: acrylic acid 3%, Tg (glass transition temperature): 30° C.) which was agitated, followed by agitating and mixing, thereby a mixture solution II was obtained.

Then, the mixture solution II was agitated and mixed while gradually adding dropwise to a 20% by mass pigment dispersion, and, thereby 100 g of cyan pigment ink C (cyan ink) was prepared. By use of a pH meter WM-50EG (trade name, manufactured by DKK-TOA CORPORATION), the pH of the pigment ink C prepared as mentioned above was measured and a pH value thereof was 8.5.

(2) Preparation of Magenta Pigment Ink M

Except that, in the preparation of the pigment ink C, in place of a pigment used in the preparation of the pigment ink C, CROMOPHTAL JET MAGENTA DMQ (PR-122) (trade name, manufactured by Ciba Specialty Chemicals Inc.) was used, according to a method similar to that of the pigment ink C, magenta pigment ink M (magenta ink) was prepared. By use of a pH meter WM-50EG (trade name, manufactured by DKK-TOA CORPORATION), the pH of the pigment ink M prepared as mentioned above was measured and a pH value thereof was 8.5.

(3) Preparation of Yellow Pigment Ink Y

Except that, in the preparation of a pigment ink C, in place of a pigment used in the preparation of the pigment ink C, IRGALITE YELLOW GS (PY74) (trade name, manufactured by Ciba Specialty Chemicals Inc.) was used, according to a method similar to that of the pigment ink C, yellow pigment ink Y (yellow ink) was prepared. By use of a pH meter WM-50EG (trade name, manufactured by DKK-TOA CORPORATION), the pH of the pigment ink Y prepared as mentioned above was measured and a pH value thereof was 8.5.

(4) Preparation of Black Pigment Ink K

Except that, in the preparation of a pigment ink C, in place of a pigment dispersion used in the preparation of the pigment ink C, CAB-O-JETTM_200 (carbon black) (trade name, manufactured by Cabot Corporation) was used, according to a method similar to that of the pigment ink C, black pigment ink K (black ink) was prepared. By use of a pH meter WM-50EG (trade name, manufactured by DKK-TOA CORPORATION), the pH of the pigment ink K prepared as mentioned above was measured and a pH value was 8.5.

<Preparation of Treatment Solution>

A treatment solution was prepared by mixing components shown below.

| | |
|---|---|
| phosphoric acid | 10 g |
| glycerin | 20 g |
| diethylene glycol | 10 g |
| OLFINE E1010 (manufactured by Nisshin Chemical Industry Co. Ltd.) | 1 g |
| ion exchange water | 59 g |

By use of a pH meter WM-50EG (trade name, manufactured by DKK-TOA CORPORATION), the pH of the treatment solution prepared as mentioned above was measured and a pH value thereof was 1.0.

<Image Formation, and Droplet Jetting Method and Conditions>

Figure 3:
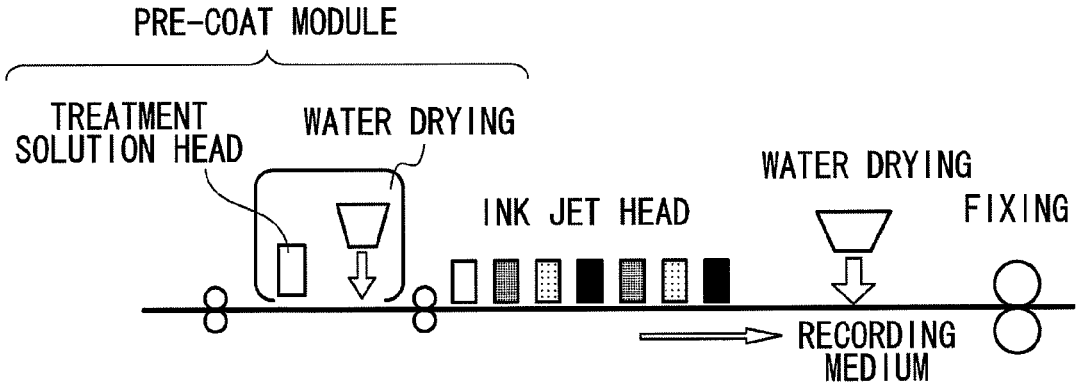
FIG. 3 is an explanatory diagram for explaining an example of an inkjet recording method involving a second aspect that uses a recording medium of the invention.

With the cyan pigment ink C, magenta pigment ink M, yellow pigment ink Y, black pigment ink K and treatment solution, by use of a unit shown in FIG. 3, under the conditions below, a 4 color single pulse image was formed. At that time, a grey scale and a character image were formed.

—Treatment Solution Head for Pre-Coat Module—

Head: 600 dpi/20 inch width piezo full-line head

Amount of discharge droplet: two-values recording of 0, 4.0 pL

Drive frequency: 15 kHz (conveying speed of recording medium: 635 mm/sec)

Image drawing pattern: a pattern that imparts, in the ink drawing step, a treatment solution in advance to positions where color ink of at least one color is drawn is applied.

~Water Drying (Air Blow Drying) for Pre-Coat Module

Speed of wind: 15 m/sec

Temperature: a contact planar heater was used to heat from a back surface of a recording surface of a recording medium so that a surface temperature of the recording medium may be 60° C.

Air blowing region: 450 mm (drying time: 0.7 sec)

—Ink Drawing—

Head: a 1,200 dpi/20 inch width piezo full-line head was disposed for each of four colors Amount of discharge droplet: four-values recording of 0, 2.0, 3.5, 4.0 pL Drive frequency: 30 kHz (conveying speed of recording medium: 635 mm/sec)

—Drying (Water Drying, Air Blow Drying)—

Speed of wind: 15 m/s

Temperature: 60° C.

Air blow region: 640 mm (drying time: 1 sec)

—Heating and Fixing—

Silicone rubber roller (hardness: 50°, nip width: 5 mm)

Roller temperature: 90° C.

Pressure: 0.8 MPa

Subsequently, the evaluation 5. shown below was carried out.

—5. Tape Peelability—

At 3 hr after an image was formed on an inkjet recording medium, a printed matter was bonded to a 12 mm wide mending tape (manufactured by 3M Corporation), thereafter, the mending tape was peeled, and, a peeling state of the printed matter was visually evaluated based on criteria shown below.

<Evaluation Criteria>

A: The printed matter was not peeled.

B: The printed matter was peeled. However, an image on the paper was not apparently affected.

C: The printed matter was peeled with an image on the paper partially remained.

D: The printed matter was vigorously peeled and an image hardly remained on the paper.

Example 2

Except that, in example 1, in place of 62 parts of the water dispersion of 22.5% urethane latex used in the second layer, 40 parts of water dispersion of 35% acryl silicone latex (glass transition temperature: 25° C., the minimum film-forming temperature: 20° C.; trade name: AQUABRID ASI-91, manufactured by Daicel Chemical Industries, Ltd.) was used, in a manner substantially similarly to example 1, an inkjet recording medium of the invention was prepared, followed by evaluating. Evaluation results are shown in Table 1 below.

Example 3

Except that, in example 1, in place of 62 parts of the water dispersion of 22.5% urethane latex used in the second layer, 70 parts of water dispersion of 20% urethane latex (glass transition temperature: 27° C., the minimum film-forming temperature: 16° C.; trade name: HYDRAN AP-20, manufactured by DIC Corporation) was used, in a manner substantially similarly to example 1, an inkjet recording medium of the invention was prepared, followed by evaluating. Evaluation results are shown in Table 1 below.

Example 4

Except that, in example 1, in place of 62 parts of the water dispersion of 22.5% urethane latex used in the second layer, 33 parts of water dispersion of 42% urethane latex (glass transition temperature: −12° C., the minimum film-forming temperature: 0° C. or less; trade name: HYDRAN AP-60LM, manufactured by DIC Corporation) was used, in a manner substantially similarly to example 1, an inkjet recording medium of the invention was prepared, followed by evaluating. Evaluation results are shown in Table 1 below.

Example 5

Except that, in example 2, in place of 100 parts of the water dispersion of 22.5% urethane latex used in the first layer, 64 parts of water dispersion of 35% acryl silicone latex (glass transition temperature: 25° C., the minimum film-forming temperature: 20° C.; trade name: AQUABRID ASI-91, manufactured by Daicel Chemical Industries, Ltd.) was used, in a manner substantially similarly to example 2, an inkjet recording medium of the invention was prepared, followed by evaluating. Evaluation results are shown in Table 1 below.

Comparative Example 1

Except that, in example 1, in place of 62 parts of the water dispersion of 22.5% urethane latex used in the second layer, 70 parts of water dispersion of 20% urethane latex (glass transition temperature: 61° C., the minimum film-forming temperature: 60° C.; trade name: HYDRAN AP-30F, manufactured by DIC Corporation) was used, in a manner substantially similarly to example 1, an inkjet recording medium of the invention was prepared, followed by evaluating. Evaluation results are shown in Table 2 below.

Comparative Example 2

Except that, in example 1, in place of 100 parts of the water dispersion of 22.5% urethane latex used in the first layer, 64 parts of water dispersion of 35% urethane latex (glass transition temperature: 27° C., the minimum film-forming temperature: 16° C.; trade name: HYDRAN AP-20, manufactured by DIC Corporation) was used, in a manner substantially similarly to example 1, an inkjet recording medium of the invention was prepared, followed by evaluating. Evaluation results are shown in Table 2 below.

Comparative Example 3

Except that, in example 1, in place of 100 parts of the water dispersion of 22.5% urethane latex used in the first layer, 54 parts of water dispersion of 42% urethane latex (glass transition temperature: −12° C.; trade name: HYDRAN AP-60LM, manufactured by DIC Corporation) was used, in a manner substantially similarly to example 1, an inkjet recording medium of the invention was prepared, followed by evaluating. Evaluation results are shown in Table 2 below.

Comparative Example 4

Except that, in example 1, in place of 62 parts of the water dispersion of 22.5% urethane latex used in the second layer, 36 parts of water dispersion of 39% SBR latex (glass transition temperature: 40° C.; trade name: LACSTER DS-226, manufactured by DIC Corporation) was used, in a manner substantially similarly to example 1, an inkjet recording medium of the invention was prepared, followed by evaluating. Evaluation results are shown in Table 2 below.

Comparative Example 5

Except that, in example 1, in place of 100 parts of the water dispersion of 22.5% urethane latex used in the first layer, 58 parts of water dispersion of 39% SBR latex (glass transition temperature: 40° C.; trade name: LACSTER DS-226, manufactured by DIC Corporation) was used, in a manner substantially similarly to example 1, an inkjet recording medium of the invention was prepared, followed by evaluating. Evaluation results are shown in Table 2 below.

Comparative Example 6

Except that, in example 1, a dry mass of a film-forming solution for the first layer was changed to 4 g/m$^2$, in a manner substantially similarly to example 1, an inkjet recording medium of the invention was prepared and evaluated. Evaluation results are shown in Table 2 below.

Comparative Example 7

Except that, in example 1, a dry mass of a film-forming solution for the second layer was changed to 10 g/m$^2$, in a manner substantially similarly to example 1, an inkjet recording medium of the invention was prepared and evaluated. Evaluation results are shown in Table 2 below.

TABLE 1

| | Example 1 | Example 2 | Example 3 | Example 4 | Example 5 |
|---|---|---|---|---|---|
| Second Layer | Urethane (AP40F, Tg = 49° C.) | Acrylic (ASi91, Tg = 25° C.) | Urethane (AP20, Tg = 27° C.) | Urethane (AP60LM, Tg = −12° C.) | Acrylic (ASi91, Tg = 25° C.) |
| First Layer | Urethane (AP40F, Tg = 49° C.) | Urethane (AP40F, Tg = 49° C.) | Urethane (AP40F, Tg = 49° C.) | Urethane (AP40F, Tg = 49° C.) | Acrylic (ASi91, Tg = 25° C.) |
| Amount of water absorption | 3.8 | 3.7 | 3.5 | 3.4 | 3.6 |
| Cobb water absorption degree | 0.9 | 0.9 | 0.9 | 0.9 | 0.8 |
| Water resistance | A | A | A | A | A |
| Curl test | A | A | A | A | A |
| Tape peelability | A | A | A | A | A |

TABLE 2

| | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| Second Layer | Urethane (AP30F, Tg = 61° C.) | Urethane (AP40F, Tg = 49° C.) | Urethane (AP40F, Tg = 49° C.) | SBR (Tg = 40° C.) | Urethane (AP40F, Tg = 49° C.) | Urethane (AP40F, Tg = 49° C.) | Urethane (AP40F, Tg = 49° C.) |
| First Layer | Urethane (AP40F, Tg = 49° C.) | Urethane (AP20, Tg = 27° C.) | Urethane (AP60LM, Tg = −12° C.) | Urethane (AP40F, Tg = 49° C.) | SBR (Tg = 40° C.) | Urethane (AP40F, Tg = 49° C.) | Urethane (AP40F, Tg = 49° C.) |
| Amount of water absorption | 3.7 | 3.8 | 3.9 | 3.5 | 3.9 | 10.3 | 1.9 |
| Cobb water absorption degree | 0.9 | 2.9 | 5.6 | 0.9 | 3.2 | 0.9 | 0.9 |
| Water resistance | A | A | A | C | A | A | A |
| Curl test | A | C | D | A | D | A | C |
| Tape peelability | C | A | A | B | A | D | A |

From the results of Tables 1 and 2, it is found that, in examples where the Cobb water absorption degree during a contact time of 120 sec according to the water absorption test based on JIS P8140 is set to 2.0 g/m$^2$ or less and an amount of water absorption during a contact time of 0.5 sec according to the Bristow method of the second layer is set from 2 to 8 mL/m$^2$, in comparison with comparative examples, the curl is suppressed from occurring or the water resistance or the tape peelability (image fixability) are improved.

According to the exemplary embodiment of the invention, a recording medium excellent in the water resistance and image fixability and a producing method thereof and an inkjet recording method that uses the recording medium are provided.

More specifically, according to exemplary embodiments of the present invention, there are provided following items of from <1> to <12>:

<1>: A recording medium, comprising: sequentially laminated, a base paper; a first layer containing a binder; and a second layer containing a white pigment and at least one selected from the group consisting of a urethane resin and an acrylic resin, which each have a glass transition temperature of 50° C. or less, wherein a Cobb water absorption degree during a contact time of 120 sec in a water absorption test in accordance with JIS P8140 on a surface of the first layer disposed on the base paper is disposed is 2.0 g/m$^2$ or less, and an amount of water absorption during a contact time of 0.5 sec in the Bristow method on a surface of the second layer is 2 mL/m$^2$ or more and 8 mL/m$^2$ or less.

<2>: The recording medium according to the item <1>, wherein a content of the white pigment in the second layer is from 70% to 96% by mass with respect to a total solid content of the second layer.

<3>: The recording medium according to the item <1> or <2>, wherein the binder in the first layer contains a thermoplastic resin.

<4>: The recording medium according to the item <3>, wherein the thermoplastic resin is at least one selected from the group consisting of a urethane resin and an acrylic resin.

<5>: The recording medium according to the item <3> or <4>, wherein the glass transition temperature of the thermoplastic resin is 30° C. or more.

<6>: The recording medium according to any one of the items <1> to <5>, wherein the acrylic resin is an acryl silicone resin.

<7>: The recording medium according to any one of the items <1> to <6>, wherein the first layer further contains a white pigment.

<8>: The recording medium according to any one of the items <1> to <7>, wherein the white pigment is kaolin.

<9>: A method of producing the recording medium according to any one of the items <3> to <8>, comprising: forming, on a base paper, a film-forming solution containing thermoplastic resin particles, followed by heating in a temperature region equal to or more than the minimum film-forming temperature of the thermoplastic resin particles to form a first layer; and forming, on the first layer, a film-forming solution containing a white pigment and at least one selected from the group consisting of a urethane resin and an acrylic resin, which each have a glass transition temperature of 50° C. or less, to form a second layer.

<10>: The method of producing a recording medium according to the item <9>, wherein the thermoplastic resin particles comprise at least one selected from the group consisting of a urethane resin latex and an acrylic resin latex.

<11>: An inkjet recording method, comprising: applying an ink to the recording medium according to any one of the items <1> to <8> to perform ink drawing in accordance with predetermined image data; and drying and removing an ink solvent in the ink drawn recording medium.

<12>: An inkjet recording method, comprising: applying a treatment solution containing an acidic substance to the recording medium according to any one of the items <1> to <8>; applying an ink to the recording medium to which the treatment solution is fed to perform ink drawing in accordance with predetermined image data; and drying and removing an ink solvent in the ink drawn recording medium.

The foregoing description of the exemplary embodiments of the present invention has been provided for the purposes of illustration and description. It is not intended to be exhaustive or to limit the invention to the precise forms disclosed. The embodiments were chosen and described in order to best explain the principles of the invention and its practical applications, thereby enabling others skilled in the art to understand the invention for various embodiments and with the various modifications as are suited to the particular use contemplated.

All publications, patent applications, and technical standards mentioned in this specification are herein incorporated by reference to the same extent as if such individual publication, patent application, or technical standard was specifically and individually indicated to be incorporated by reference. It will be obvious to those having skill in the art that many changes may be made in the above-described details of the preferred embodiments of the present invention. It is intended that the scope of the invention be defined by the following claims and their equivalents.

What is claimed is:

1. A recording medium, comprising:

sequentially laminated, a base paper;

a first layer containing a binder; and a second layer containing a white pigment and at least one selected from the group consisting of a urethane resin and an acrylic resin, which each have a glass transition temperature of 50° C. or less, wherein a Cobb water absorption degree during a contact time of 120 sec in a water absorption test in accordance with JIS P8140 on a surface of the first layer disposed on the base paper is 2.0 g/m$^2$ or less, and an amount of water absorption during a contact time of 0.5 sec in the Bristow method on a surface of the second layer is 2 mL/m$^2$ or more and 8 mL/m$^2$ or less.

2. The recording medium of claim 1, wherein a content of the white pigment in the second layer is from 70% to 96% by mass with respect to a total solid content of the second layer.

3. The recording medium of claim 1, wherein the binder in the first layer contains a thermoplastic resin.

4. The recording medium of claim 3, wherein the thermoplastic resin is at least one selected from the group consisting of a urethane resin and an acrylic resin.

5. The recording medium of claim 3, wherein the glass transition temperature of the thermoplastic resin is 30° C. or more.

6. The recording medium of claim 1, wherein the acrylic resin is an acryl silicone resin.

7. The recording medium of claim 1, wherein the first layer further contains a white pigment.

8. The recording medium of claim 1, wherein the white pigment is kaolin.

9. A method of producing the recording medium of claim 3, comprising:

forming, on a base paper, a film-forming solution containing thermoplastic resin particles, followed by heating in a temperature region equal to or more than the minimum film-forming temperature of the thermoplastic resin particles to form a first layer; and forming, on the first layer, a film-forming solution containing a white pigment and at least one selected from the group consisting of a urethane resin and an acrylic resin, which each have a glass transition temperature of 50° C. or less, to form a second layer.

10. The method of producing a recording medium of claim 9, wherein the thermoplastic resin particles comprise at least one selected from the group consisting of a urethane resin latex and an acrylic resin latex.

11. An inkjet recording method, comprising:

applying an ink to the recording medium of claim 1 to perform ink drawing in accordance with predetermined image data; and drying and removing an ink solvent in the ink drawn recording medium.

12. An inkjet recording method, comprising:

applying a treatment solution containing an acidic substance to the recording medium of claim 1;

applying an ink to the recording medium to which the treatment solution is fed, to perform ink drawing in accordance with predetermined image data; and drying and removing an ink solvent in the ink drawn recording medium.

* * * * *